US007190912B2

(12) United States Patent
Kato

(10) Patent No.: US 7,190,912 B2
(45) Date of Patent: Mar. 13, 2007

(54) TANDEM TYPE COLOR IMAGE FORMING APPARATUS

(75) Inventor: Shinji Kato, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 268 days.

(21) Appl. No.: 10/864,524

(22) Filed: Jun. 10, 2004

(65) Prior Publication Data

US 2005/0019048 A1 Jan. 27, 2005

(30) Foreign Application Priority Data

Jun. 12, 2003 (JP) ..... 2003-168049
Sep. 19, 2003 (JP) ..... 2003-328751
Mar. 5, 2004 (JP) ..... 2004-061914

(51) Int. Cl.
*G03G 15/00* (2006.01)
*G03G 15/08* (2006.01)

(52) U.S. Cl. ..... 399/49; 399/60

(58) Field of Classification Search ..... 399/49, 399/60, 258, 39

See application file for complete search history.

(56) References Cited

U.S. PATENT DOCUMENTS 5,053,827 A * 10/1991 Tompkins et al.
5,231,452 A 7/1993 Murayama et al.
5,327,196 A 7/1994 Kato et al.
5,387,965 A 2/1995 Hasegawa et al.
5,475,476 A 12/1995 Murai et al.
5,493,382 A 2/1996 Takagaki et al.
5,604,575 A 2/1997 Takagaki et al.
5,671,470 A 9/1997 Maruta et al.
5,682,572 A 10/1997 Murai et al.
5,737,680 A 4/1998 Takagaki et al.
5,758,235 A 5/1998 Kosuge et al.
5,765,059 A 6/1998 Kosuge et al.
5,768,664 A 6/1998 Kosuge et al.
5,826,146 A 10/1998 Maruta et al.
5,860,038 A 1/1999 Kato et al.
5,970,276 A 10/1999 Kato
6,055,386 A 4/2000 Kato et al.
6,081,678 A 6/2000 Kato
6,141,520 A 10/2000 Kosuge (Continued)

FOREIGN PATENT DOCUMENTS

JP 2000-206761 7/2000
JP 2000206761 A * 7/2000
JP 2003-338637 11/2003

OTHER PUBLICATIONS

U.S. Appl. No. 11/477,673, filed Jun. 30, 2006, Watanabe et al.
U.S. Appl. No. 11/492,789, filed Jul. 26, 2006, Ishibashi et al.

*Primary Examiner*—Susan Lee
(74) *Attorney, Agent, or Firm*—Oblon, Spivak, McClelland, Maier & Neustadt, P.C.

(57) ABSTRACT

An image forming apparatus includes a plurality of image bearing members that bear a latent image each and a detector corresponding to each image bearing member. The detectors optically detect density of toner images present on corresponding one of the image bearing members. At least two of the detectors are shifted in the direction of the axis of rotation of the corresponding image bearing member as compared to other detectors.

16 Claims, 23 Drawing Sheets

U.S. PATENT DOCUMENTS

| | | | |
|---|---|---|---|
| 6,195,519 | B1 | 2/2001 | Isobe et al. |
| 6,526,235 | B2 | 2/2003 | Kato |
| 6,594,453 | B2 | 7/2003 | Kato |
| 6,597,881 | B2 | 7/2003 | Hatori et al. |
| 6,788,915 | B2 | 9/2004 | Sakamoto |
| 2003/0180057 | A1 | 9/2003 | Sawada et al. |

* cited by examiner

FIG.15

T1

| NO. | Vmax | VD | VB | VL |
|---|---|---|---|---|
| 1 | 160 | 400 | 260 | 110 |
| 2 | 180 | 429 | 286 | 118 |
| 3 | 200 | 457 | 311 | 126 |
| 4 | 220 | 486 | 337 | 133 |
| 5 | 240 | 514 | 363 | 141 |
| ⋮ | ⋮ | ⋮ | ⋮ | ⋮ |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |

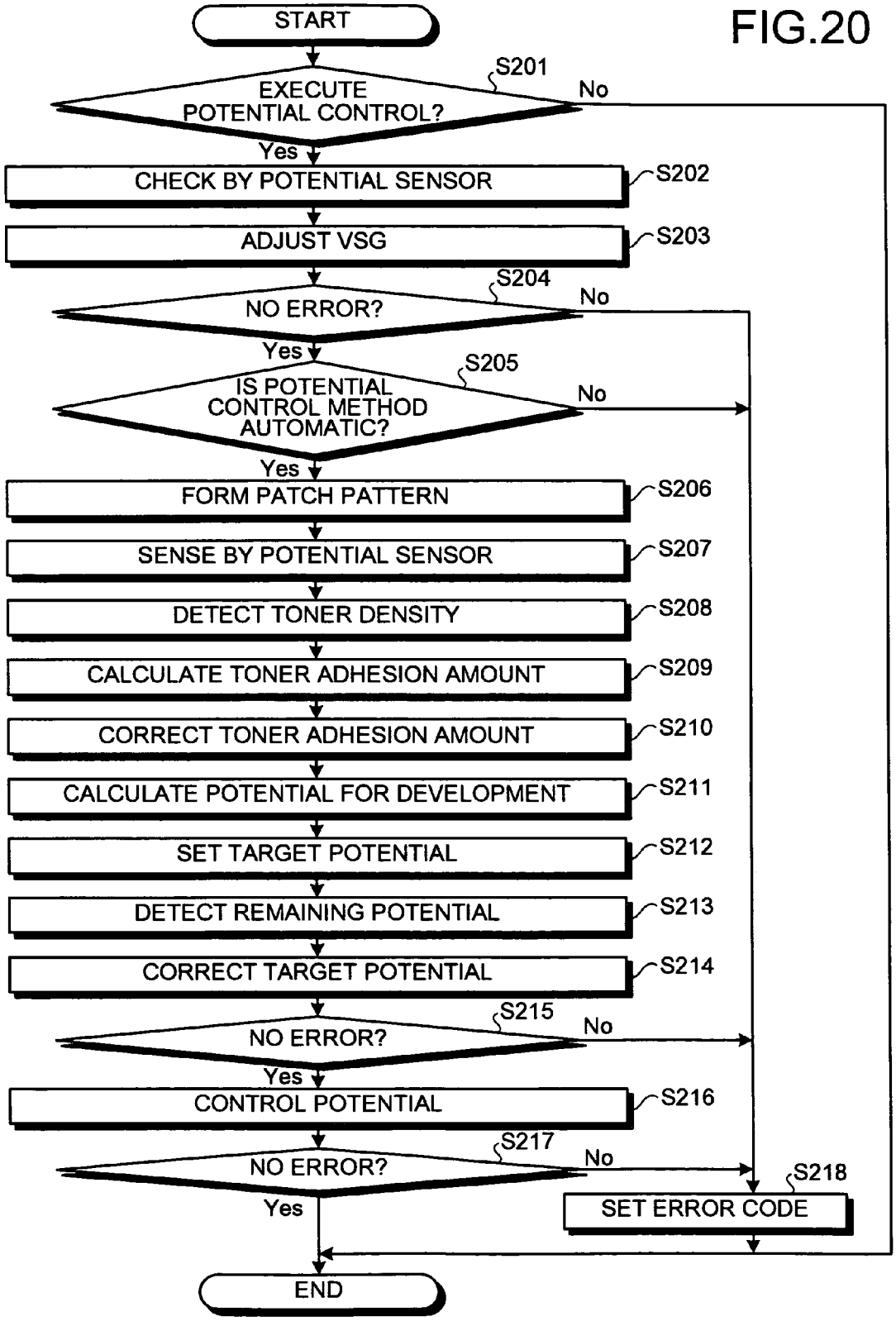
FIG.20
START
S201
EXECUTE POTENTIAL CONTROL?
No
Yes
CHECK BY POTENTIAL SENSOR
S202
ADJUST VSG
S203
S204
NO ERROR?
No
Yes
S205
IS POTENTIAL CONTROL METHOD AUTOMATIC?
No
Yes
FORM PATCH PATTERN
S206
SENSE BY POTENTIAL SENSOR
S207
DETECT TONER DENSITY
S208
CALCULATE TONER ADHESION AMOUNT
S209
CORRECT TONER ADHESION AMOUNT
S210
CALCULATE POTENTIAL FOR DEVELOPMENT
S211
SET TARGET POTENTIAL
S212
DETECT REMAINING POTENTIAL
S213
CORRECT TARGET POTENTIAL
S214
S215
NO ERROR?
No
Yes
CONTROL POTENTIAL
S216
S217
NO ERROR?
No
Yes
S218
SET ERROR CODE
END

FIG.28

T1

| NO. | Vmax | VD | VB | VL |
|---|---|---|---|---|
| 1 | 160 | 400 | 260 | 110 |
| 2 | 180 | 429 | 286 | 118 |
| 3 | 200 | 457 | 311 | 126 |
| 4 | 220 | 486 | 337 | 133 |
| 5 | 240 | 514 | 363 | 141 |
| ⋮ | ⋮ | ⋮ | ⋮ | ⋮ |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |

TANDEM TYPE COLOR IMAGE FORMING APPARATUS

CROSS-REFERENCE TO RELATED APPLICATIONS

The present document incorporates by reference the entire contents of Japanese priority document, 2003-168049 filed in Japan on Jun. 12, 2003, 2003-328751 filed in Japan on Sep. 19, 2003 and 2004-061914 filed in Japan on Mar. 5, 2004.

BACKGROUND OF THE INVENTION

1) Field of the Invention

The present invention relates to a tandem type color image forming apparatus that detects toner density and controls image density based on the toner density detected.

2) Description of the Related Art

In recent years, there is increasing demand for achieving high productivity in image forming apparatuses that output color images according to the electrophotographic method. To respond to this demand, a tandem type image forming apparatuses have become developed. The tandem type image forming apparatuses include a plurality of image forming units, each having an image bearing member and a developer, are arranged in parallel so as to oppose to a transfer belt, and toner images on the image bearing members are sequentially transferred onto transfer paper (or transfer belt).

Japanese Patent Application Laid-Open No. 2000-206761 discloses an image forming apparatus that use a special technique. In this technique a reference toner patch is formed on an image bearing member or an intermediate transfer member, the toner density of the reference toner patch is detected by using an optical toner density sensor, and the image density is controlled based on the toner density detected.

However, the image forming apparatus, for example, the one disclosed in Japanese Patent Application Laid-Open No. 2000-206761, has problems as explained below.

Since the toner density sensors provided for each photoconductor are disposed at the same position with regard to the width direction of the photoconductors (width direction of the intermediate transfer belt) and one or more reference toner patches are formed in parallel for each color at the same position with regard to the width direction of each photoconductor so as to be detected by the respective toner sensors, the reference toner patches for each color, overlap on the intermediate transfer belt. As a result, unnecessarily large amount of toner is deposited on the intermediate transfer belt and that has to be cleaned by the intermediate transfer belt cleaner and the secondary transfer cleaner. Sometimes the intermediate transfer belt cleaner and the secondary transfer cleaner can not totally clean the toner because of its large quantity and this cause deterioration in the image quality.

One approach is to form toner patches for different color one after the other without overlapping the toner patches. However, this approach requires idle running. For example, if there are four colors, it takes almost four times longer time.

In other approach, toner density of reference toner patches is detected while shifting installing positions of toner sensors and imaging positions of the reference toner patches corresponding respective colors. However, since the intermediate transfer belt rubs against the transfer paper, and the transfer paper is easily damaged, the surface condition of the transfer belt is not uniform and the detection results obtained by the toner density sensors (for each color) disposed at different positions with regard to the width direction of the intermediate transfer belt significantly change. Therefore, detection stability is not ensured.

Also, when toner density changes in the image forming apparatus that detects toner density on an intermediate transfer belt, whether the cause of this change is toner density in the developer, potential of photoconductor or transfer rate of the intermediate transfer belt is unclear. For example, in the situation that the cause of decrease in toner density on the intermediate transfer belt is abnormal transfer rate to the intermediate transfer belt, if an attempt is made to increase the toner density by increasing the toner supply amount to the developer, the toner scattering may occur. Thus, detection of toner density on the intermediate transfer belt entails problems.

SUMMARY OF THE INVENTION

It is an object of the present invention to solve at least the problems in the conventional technology.

An image forming apparatus according to an aspect of the present invention includes a plurality of image bearing members, wherein each image bearing member is rotatable around an axis of rotation and bears a latent image; a charging unit that electrically charge the image bearing member; a light illuminating unit corresponding to each image bearing member, wherein the light exposing unit illuminates light on a corresponding one of the image bearing members so as to form a latent image on the image bearing member; a developing unit corresponding to each image bearing member, wherein the developing unit develops the latent image on a corresponding one of the image bearing members to a toner image; an intermediate transfer belt onto which the toner images on the image bearing members are transferred and from where the toner images are transferred onto a recording medium; a driving unit that drives and rotates the intermediate transfer belt; a supplying unit that supplies the recording medium to the intermediate transfer belt; and a detector corresponding to each image bearing member, wherein the detector optically detects a density of a toner image present on a corresponding one of the image bearing members, wherein at least two of the detectors are shifted in the direction of the axis of rotation of the corresponding image bearing member as compared to other detectors.

An image forming apparatus according to another aspect of the present invention includes a plurality of image bearing members, wherein each image bearing member is rotatable around an axis of rotation and bears a latent image; a charging unit that electrically charge the image bearing member; a light illuminating unit corresponding to each image bearing member, wherein the light exposing unit illuminates light on a corresponding one of the image bearing members so as to form a latent image on the image bearing member; a developing unit corresponding to each image bearing member, wherein the developing unit develops the latent image on a corresponding one of the image bearing members to a toner image; an intermediate transfer belt onto which the toner images on the image bearing members are transferred and from where the toner images are transferred onto a recording medium; a driving unit that drives and rotates the intermediate transfer belt; a supplying unit that supplies the recording medium to the intermediate transfer belt; a first detector corresponding to each image bearing member, wherein the first detector optically detects a density of a toner image present on a corresponding one of the image bearing members; a second detector that opposes to the intermediate transfer belt, wherein the second detector optically detects a density of a toner image present on the intermediate transfer belt; a forming unit corresponding to each image bearing member, wherein the forming unit forms a reference patch with a toner on the corresponding image bearing member and from where the reference patches are transferred onto the intermediate transfer belt; a correcting unit that corrects the density detected by the first detectors based on the density detected by the second detector to obtain a corrected density; and an image density controlling unit corresponding to each image bearing member, wherein the image density controlling unit controls supply of toner to the corresponding developing unit so as to control density of the image to be formed based on the corrected density.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 15 is a potential control table;

FIG. 20 is a flowchart of a potential control routine;

FIG. 28 is a schematic view of a potential control table.

DETAILED DESCRIPTION

Exemplary embodiments of the present invention will be explained with reference to the accompanying drawings. The embodiments assume that the image forming apparatus is a full-color electrophotographic copying machine of tandem type (hereinafter, "copying machine").

Figure 1:
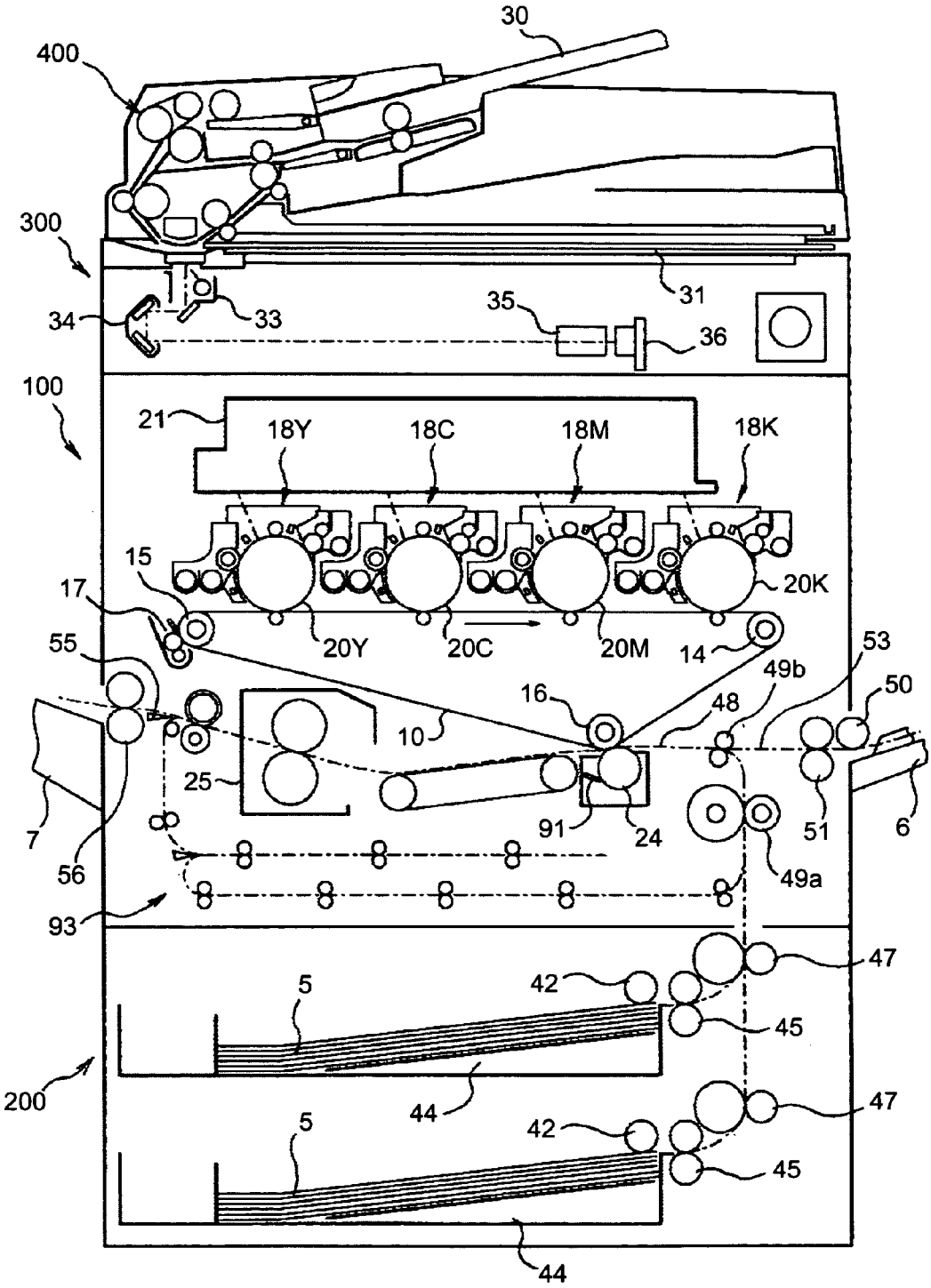
FIG. 1 is a schematic side view of a copying machine according to a first embodiment of the present invention.

FIG. 1 is a side view of the copying machine according to a first embodiment. The copying machine includes a copying machine main unit 100 that performs image formation; a paper feeder 200 above which the copying machine main unit 100 is arranged, for supplying transfer paper 5, serving as a recording medium, to the copying machine main unit 100; a scanner 300 mounted on the copying machine main unit 100, for reading a document image; and an auto document feeder (ADF) 400 mounted on the scanner 300. The copying machine main unit 100 is provided with a manual paper feeding tray 6 for allowing manual feeding of the transfer paper 5 and a paper discharge tray 7 to which the transfer paper 5 that has been formed with an image is discharged.

Figure 2:
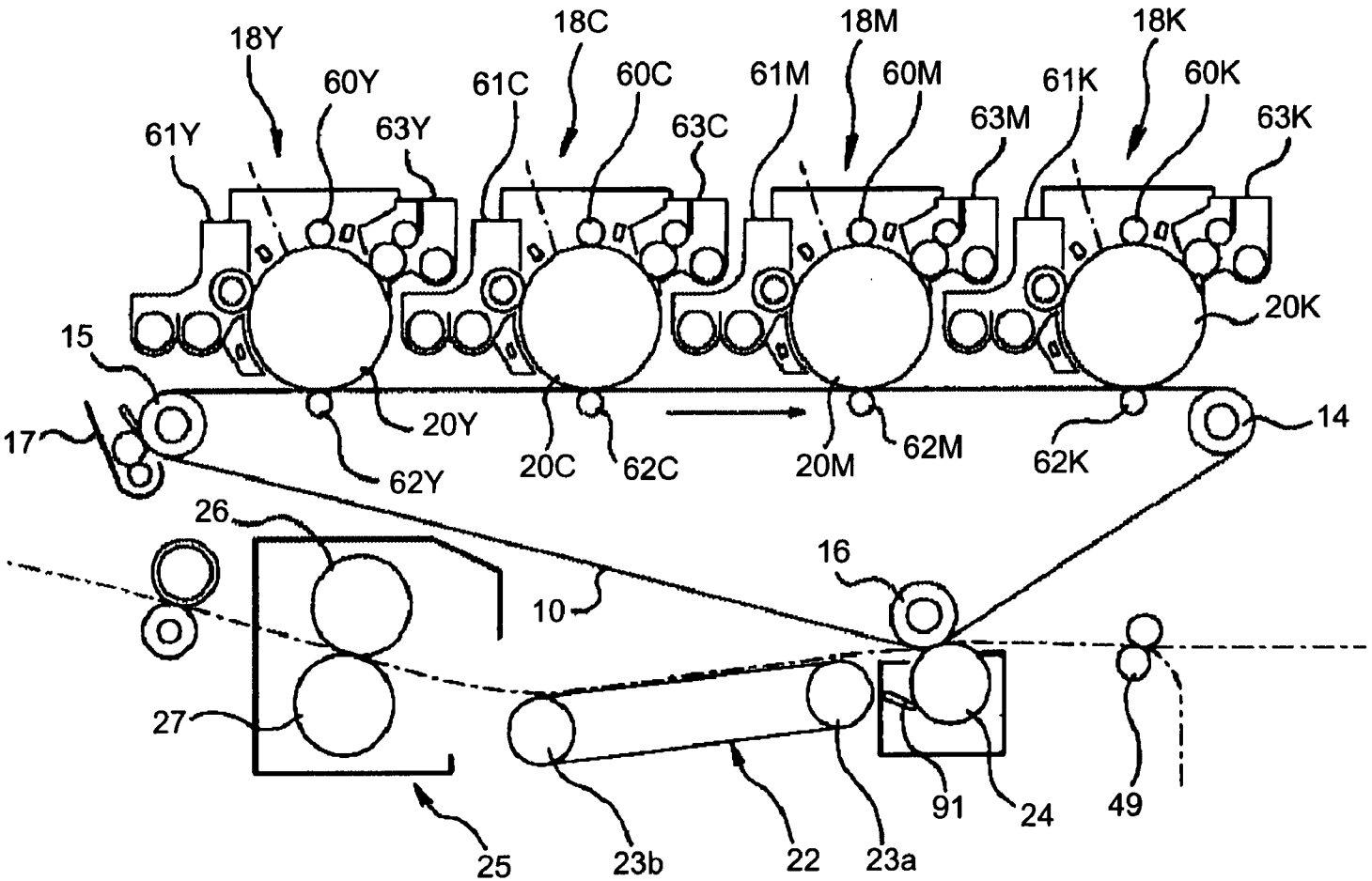
FIG. 2 is an enlarged side view of a main unit of the copying machine.
Figure 3:
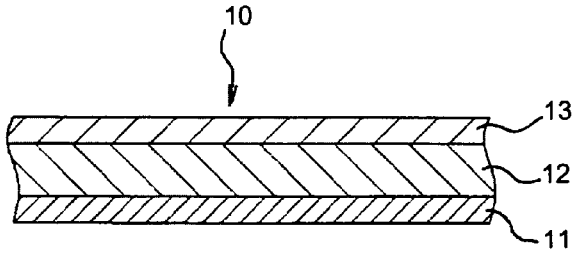
FIG. 3 is a cross section of a structure of an intermediate transfer belt.

FIG. 2 is an enlarged side view of the copying machine main unit 100. The copying machine main unit 100 is provided with an intermediate transfer belt 10 serving as an intermediate transfer member, implemented by an endless belt. As shown in FIG. 3, this intermediate transfer belt 10 has a triple layer structure consisting of a base layer 11, an elastic layer 12, and a coating layer 13. The base layer 11 can be made of, for example, fluorine-based resins of small stretch or rubber materials of large stretch, combined with materials that are resistant to stretching. The elastic layer 12 can be made of, for example, fluorine-based rubber or acrylonitrile-butadiene copolymer rubber, and formed on the base layer 11. The coating layer 13 is formed by coating the surface of the elastic layer 12 with fluorine-based resins, for example. The intermediate transfer belt 10 is rotationally driven in the clockwise direction in FIG. 2 while it is laid across three supporting rollers 14, 15, and 16 in tensioned condition.

As shown in FIG. 2, in the supporting rollers 14, 15, and 16, the belt part tensioned between the first supporting roller 14 and the second supporting roller 15 are disposed four image forming units 18Y, 18C, 18M, and 18K for yellow, cyan, magenta, and black arranged in parallel. Over these images forming units 18Y, 18C, 18M, and 18K is provided a light exposure device 21, as shown in FIG. 1. This light exposure device 21 drives a semiconductor laser (not shown) by means of a laser controller (not shown) based on image information of a document read by the scanner 300 to emit a writing beam, thereby forming electrostatic latent images on photoconductor drums 20Y, 20C, 20M, and 20K serving as image bearing members provided in the respective image forming units 18Y, 18C, 18M, and 18K. Herein, radiation of the writing beam is not limited to laser, but may be LED, for example.

Figure 4:
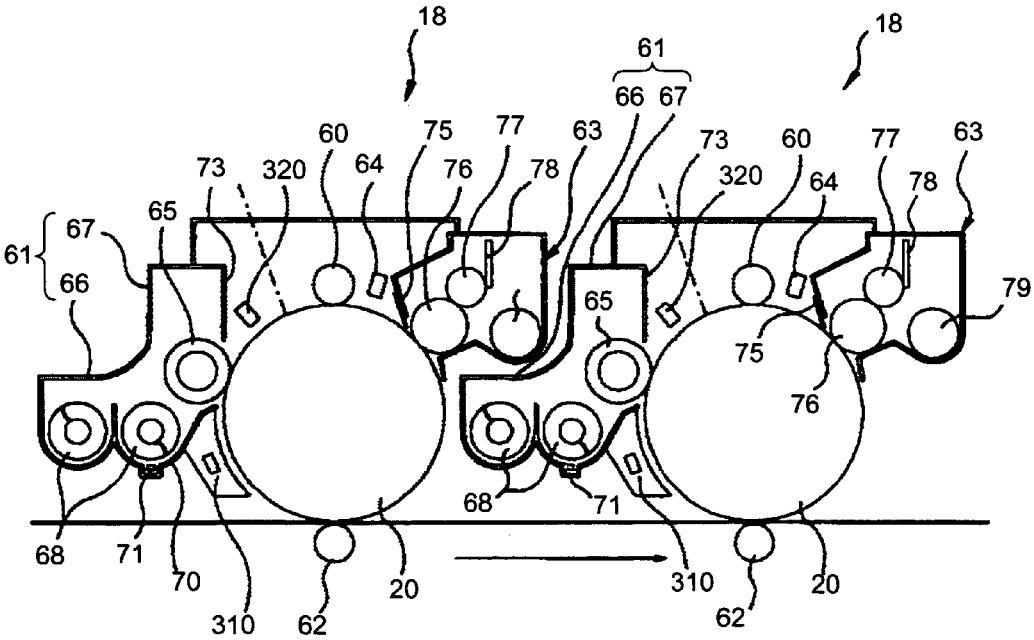
FIG. 4 is an enlarged side view of a portion neighboring image forming units.

Next, configuration of the image forming units 18Y, 18C, 18M and 18K will be explained. The following explanation will be made while taking the image forming unit 18K that forms a black toner image as an example, however, other image forming units 18Y, 18C, 18M have the similar configuration. FIG. 4 is an enlarged view depicting configuration of neighboring two image forming units 18M and 18K. In the drawing, the symbols for distinguishing by color "M" and "K" are abbreviated. Such abbreviation will be made appropriately in the following description.

The image forming unit 18 is provided with a charger 60, a developer 61, a photoconductor cleaner 63, and a charge eliminator 64 around the photoconductor drum 20. A primary transfer device 62 is provided so as to be opposite to the photoconductor drum 20 via the intermediate transfer belt 10.

The charger 60 is of a contact charging type that utilizes a charging roller, and uniformly charges the surface of the photoconductor drum 20 by application of voltage by coming into contact with the photoconductor drum 20. This charger 60 may be of a non-contact charging type which adopts non-contact Scorotron charger.

The developer 61 uses two-component developing agents composed of magnetic carriers and nonmagnetic toner. The developing agent may be a single-component developing agent. The developer 61 can be generally divided into a stirring part 66, and a developing part 67 provided in a developing case 70. In the stirring part 66, the two-component developing agent (hereinafter, simply referred to as "developing agent") is conveyed under stirring to be supplied onto a developing sleeve 65 that serves as a developing agent bearing member and will be described later. The stirring part 66 is provided with two parallel screws 68, and between the two screws 68 is provided a partition that separates these two screws while allowing communication at their ends. The developing case 70 is attached with a toner density sensor 71 for detecting toner density of the developing agent in the developer 61. On the other hand, in the developing part 67, toner in the developing agent that has adhered to the developing sleeve 65 is transferred to the photoconductor drum 20. This developing part 67 has the developing sleeve 65 disposed so as to oppose to the photoconductor drum 20 via the opening of the developing case 70. And in this developing sleeve 65, a magnet (not shown) is fixedly placed. Also a doctor blade 73 is provided so that the end thereof is close to the developing sleeve 65. In the first embodiment, the distance at the closest position between the doctor blade 73 and the developing sleeve 65 is 0.9 millimeter (mm).

In the developer 61, the developing agent is conveyed and circulated with stirred by two screws 68 and supplied to the developing sleeve 65. The developing agent supplied to the developing sleeve 65 is pumped up and held by the magnet. The developing agent pumped up by the developing sleeve 65 is conveyed in association with the rotation of the developing sleeve 65 and regulated to an appropriate amount by the doctor blade 73. The developing agent thus regulated is returned to the stirring part 66. In this manner, the developing agent having conveyed to the region opposing to the photoconductor drum 20 bristles by action of the magnet to form a magnetic brush. In the developing region, a developing electric field is formed that allows the toner in the developing agent to move to the part of the electrostatic latent image on the photoconductor drum 20 by the developing bias applied to the developing sleeve 65. As a result, the toner in the developing agent transfers to the part of the electrostatic latent image on the photoconductor drum 20 where the electrostatic latent image on the photoconductor drum 20 is visualized and a toner image is formed. The developing agent having passed through the developing region is conveyed to the part where magnetic force of the magnet is weak, leaves the developing sleeve 65 and then returned to the stirring part 66. When the density of the toner in the stirring part 66 decreases due to repetition of the operation as described above, the toner density sensor 71 detects that, and toner is supplied to the stirring part 66 based on the detection result.

The primary transfer device 62 adopts a primary transfer roller, and disposed so as to push against the photoconductor drum 20 via the intermediate transfer belt 10. The primary transfer device 62 may be of a conductive brush type or a non-contact type corona charger besides of a roller shape.

The photoconductor cleaner 63 has a cleaning blade 75, formed for example, of polyurethane rubber, disposed so that its end is pushed against the photoconductor drum 20. Furthermore, in the first embodiment, a conductive fur brush 76 that contacts with the photoconductor drum 20 is additionally used to improve the cleaning performance. This fur brush 76 is applied with a bias from a metallic electric field roller 77 against which an end of a scraper 78 is pushed. Then the toner removed from the photoconductor drum 20 by the cleaning blade 75 and the fur brush 76 is accommodated in the photoconductor cleaner 63. Thereafter the toner is drawn to either side of the photoconductor cleaner 63 by a collecting screw 79, and returned to the developer 61 through a toner recycler 80 for recycle use.

The charge eliminator 64 is implemented by a charge eliminating lamp, and initializes the surface potential of the photoconductor drum 20 by light irradiation.

Figure 5:
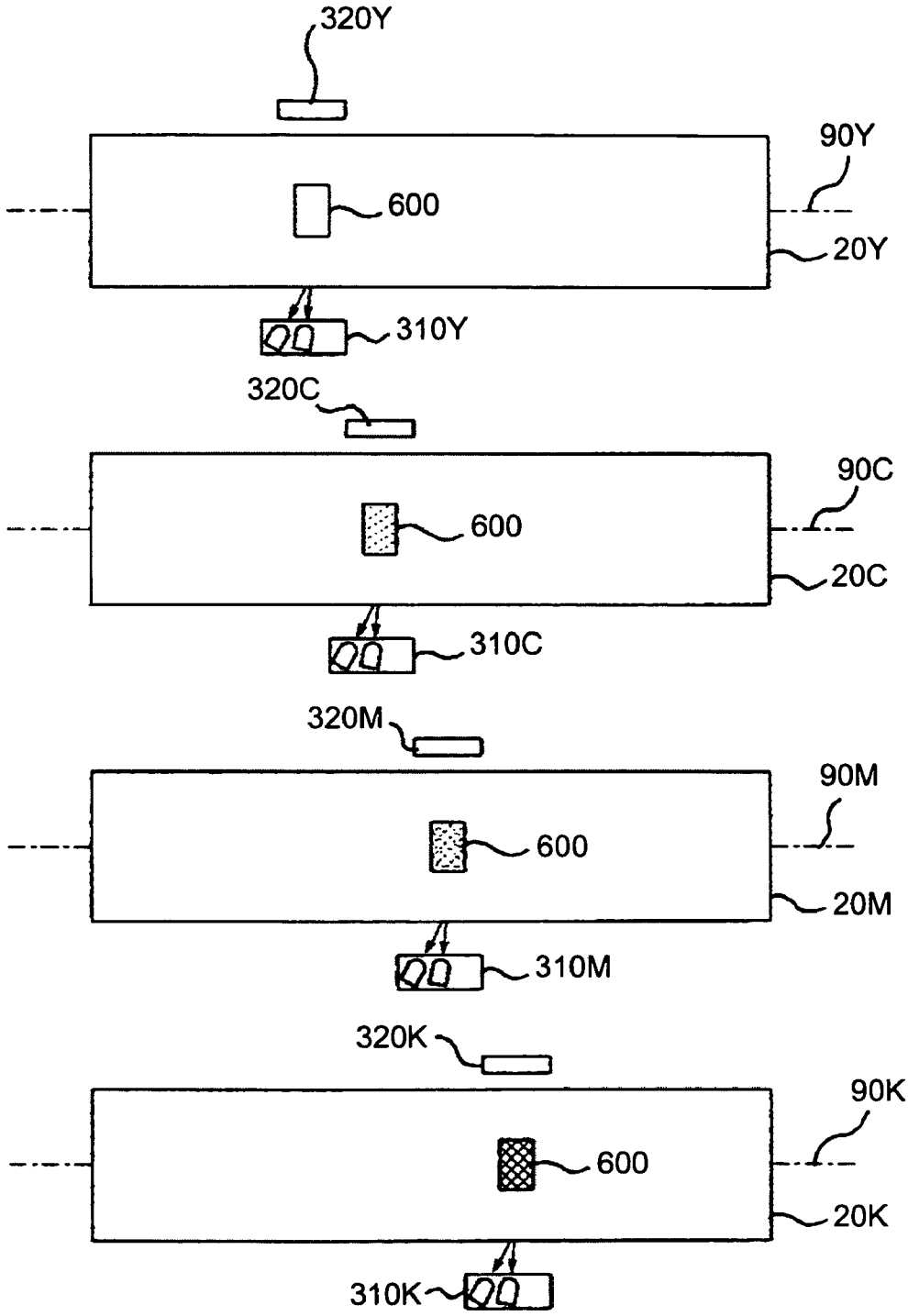
FIG. 5 is a plan view depicting a reflection density sensor, a potential sensor, and a photoconductor.

The image forming unit 18 is formed with a toner density sensor 310 and a potential sensor 320 serving as detectors, in correspondence with each photoconductor drum 20. To be more specific, as shown in FIG. 5, the toner density sensors 310 are provided for each photoconductor drum 20 so as to oppose to the respective photoconductor drums 20 while shifted from each other in the direction of axial centers 90 of the photoconductor drums 20. The toner density sensor 310 is an infrared light reflective type sensor based on the optical system, which optically detects density of a toner image formed on the surface of the photoconductor drum 20. Also the potential sensors 320 are provided for each photoconductor drum 20 so as to oppose to the respective photoconductor drums 20 while shifted from each other in the direction of axial centers 90 of the photoconductor drums 20. These potential sensors 320 detect potentials on the surface of the photoconductor drums 20.

Next, concrete settings for the image forming unit 18 will be explained. The photoconductor drum 20 has a diameter of 60 mm, and the photoconductor drum 20 is driven at a line speed of 282 mm/s. The developing sleeve 65 has a diameter of 25 mm, and driven at a line speed of 564 mm/s. The charge amount of the toner in the developing agent supplied to the developing region is preferably in the range of about −10 to −30 μC/g. A developing gap which is the space between the photoconductor drum 20 and the developing sleeve 65 can be set in the range of 0.5 mm to 0.3 mm, and it is possible to improve the developing efficiency by selecting smaller values. The photoconductive layer of the photoconductor drum 20 is 30 μm thick, the optical system of the light exposure device 21 has a beam spot diameter of 50×60 μm and light intensity of about 0.47 mW. As one example, the surface of the photoconductor drum 20 is uniformly charged to −700 volts (V) by the charger 60, and the potential of the part of the electrostatic latent image which is irradiated with laser by light exposure device 21 becomes −120 V. To the contrary, the voltage of developing bias is −470 V so as to secure the developing potential of 350 V. Such a process condition is appropriately changed depending on the result of potential control.

In the image forming unit 18 having the above configuration, as the photoconductor drum 20 rotates, first the charger 60 uniformly charges the surface of the photoconductor drum 20. Next, the light exposure device 21 emits the writing beam by laser based on the image information read by the scanner 300 to form an electrostatic latent image on the photoconductor drum 20. Thereafter, the electrostatic latent image is visualized by the developer 61 and a toner image is formed. This toner image is then primarily transferred to the intermediate transfer belt 10 by means of the primary transfer device 62. The transfer-remaining toner remaining on the surface of the photoconductor drum 20 after primary transfer is then eliminated by the photoconductor cleaner 63, after which charge on the surface of the photoconductor drum 20 is eliminated by the charge eliminator 64 to be ready for the next image formation.

Next, as shown in FIG. 2, a secondary transfer roller 24 which is the secondary transfer device is provided so as to oppose to the third supporting roller 16 of the supporting rollers. When the toner image on the intermediate transfer belt 10 is secondarily transferred onto the transfer paper 5, the secondary transfer roller 24 is pushed against the part of the intermediate transfer belt 10 that is wound on the third supporting roller 16 to thereby conduct the secondary transfer. Herein, the secondary transfer device may be configured by using a non-contact transfer charger, for example, rather than the configuration using the secondary transfer roller 24. A roller cleaning part 91 for cleaning the toner adhered to the secondary transfer roller 24 abuts on this secondary transfer roller 24.

Furthermore, on the downstream side of the conveying direction of the transfer paper 5 of the secondary transfer roller 24, an endless conveying belt 22 is laid between two rollers 23*a* and 23*b* in tensioned condition. On further downstream side of the conveying direction is provided a fixing device 25 for fixing a toner image transferred onto the transfer paper 5. In this fixing device 25, a pressurizing roller 27 is pushed against a heating roller 26. A belt cleaner 17 is provided so as to oppose to the secondary supporting roller 15 in the supporting rollers of the intermediate transfer belt 10. This belt cleaner 17 removes the toner remaining on the intermediate transfer belt 10 after transferring the toner image on the intermediate transfer belt 10 onto the transfer paper 5.

Figure 6:
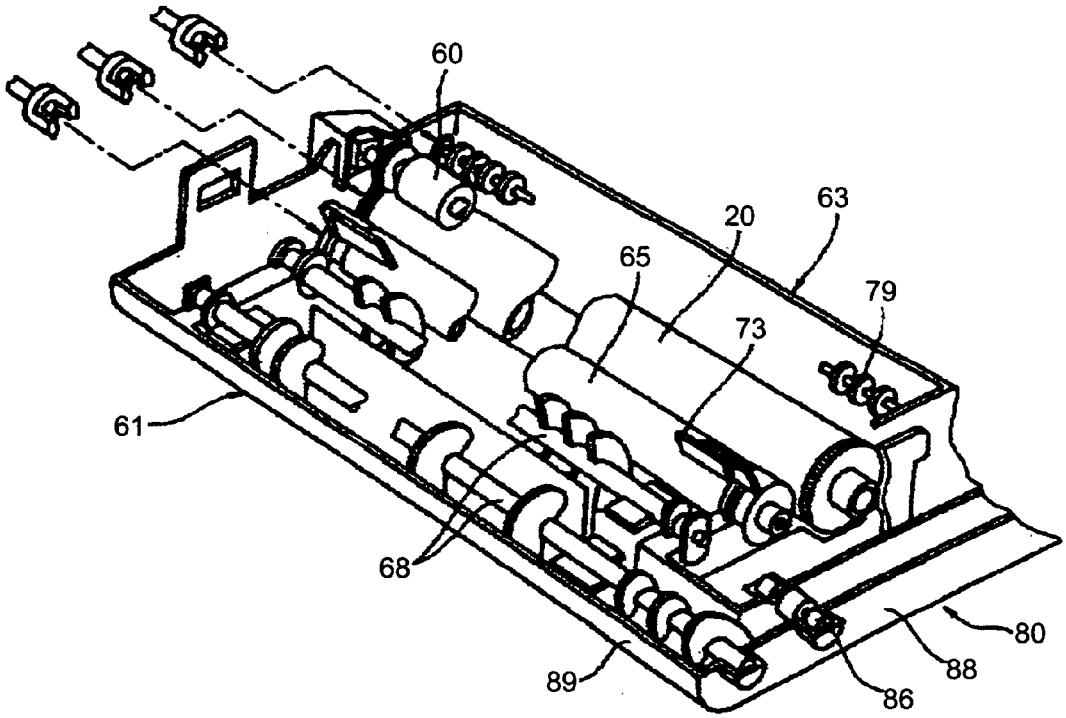
FIG. 6 is a perspective view of a toner recycler.

Next, configuration and operation of the toner recycler 80 for allowing recycle use of the transfer-remaining toner collected by the photoconductor cleaner 63 in the developer 61 will be explained. FIG. 6 is an explanatory view for schematic configuration of the toner recycler 80, and FIG. 7 is an enlarged view of one end of a collecting screw 79 of the photoconductor cleaner 63.

Figure 7:
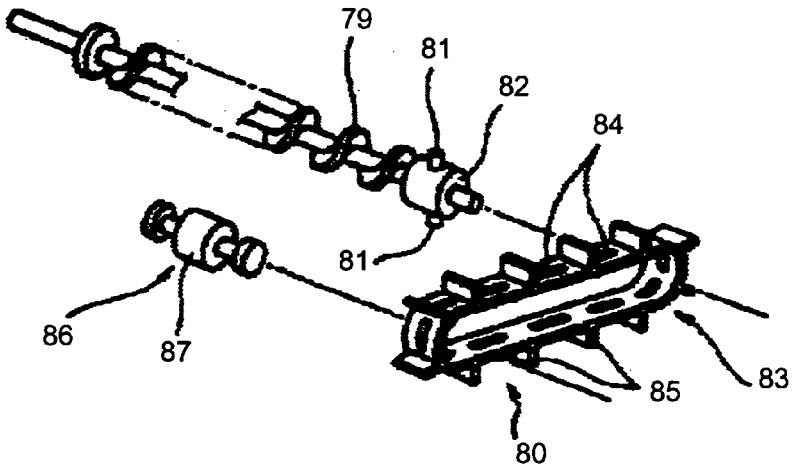
FIG. 7 is perspective view of one end portion of a recovery screw of a photoconductor cleaner.

As shown in FIG. 7, the toner recycler 80 has a roller part 82 disposed on one end of the collecting screw 79 of the photoconductor cleaner 63. The roller part 82 is provided with a pin 81. Between this roller part 82 and a roller part 87 of a rotation axis 86, a collected toner conveying member 83 implemented by a belt is laid in tensioned condition. At this time, the pin 81 of the roller part 82 is inserted into a slot 84 provided in the collected toner conveying member 83. On the outer periphery of the collected toner conveying member 83 are disposed blades 85 at constant intervals.

The collected toner conveying member 83 is accommodated in a conveying path case 88 together with the rotation axis 86, as shown in FIG. 6. This conveying path case 88 is formed integrally with a cartridge case 89 that integrally accommodates at least part of the constituents of the image forming unit 18. In the interior of the conveying path case 88, one of the two screws 68 projects from the interior of the developer 61.

In the toner recycler 80 as described above, driving force is transmitted from outside to rotate the collecting screw 79 and rotate the collected toner conveying member 83. As a result, the toner collected by the photoconductor cleaner 63 is conveyed toward the developer 61 via the conveying path case 88 and accommodated in the developer 61 by the screw 68. Thereafter, the collected toner is stirred together with the developing agent in the developer 61 by means of the two screws 68 and circulated to contribute development again.

Also the copying machine main unit 100 has a conveying path 48 that introduces the transfer paper 5 supplied from the paper feeder 200 to the paper discharge tray 7 via the secondary transfer roller 24, as shown in FIG. 1. Along this conveying path 48, a conveying roller 49*a*, a registration roller 49*b*, a discharging roller 56 and the like are provided. On the downstream side of the conveying path 48, a switching claw 55 that switches the direction to which the transfer paper 5 after transferring is to be conveyed between the direction to the paper discharge tray 7 and the direction to a paper inversing device 93. The paper inversing device 93 inverses the transfer paper 5 and sends again to the secondary transfer roller 24. Furthermore, the copying machine main unit 100 has a manual paper feeding path 53 that converges to the conveying path 48 from the manual paper feeding tray 6. On the upstream side of the manual paper feeding path 53 are provided a paper feeding roller 50 and a separating roller 51 for feeding the transfer pare 5 that is set on the manual feeding tray 6 one by one.

The paper feeder 200 includes a plurality of paper feeding cassettes 44 for accommodating the transfer paper 5; a paper feeding roller 42 and a separating roller 45 for sending the transfer paper accommodated in these paper feeding cassettes 44 one by one; a conveying roller 47 for conveying the sent transfer paper along a paper feeding path 46 and so on. The paper feeding path 46 connects to the conveying path 48 of the copying machine main unit 100.

Next, explanation about the scanner 300 will be made based on FIG. 1. In the scanner 300, a first running member 33 and a second running member 34 on which a document lighting optical source and a mirror are mounted reciprocate so as to read and scan a document (not shown) placed on a contact glass 31. Image information scanned by these running members 33 and 34 is then condensed by the imaging lens 35 onto the imaging surface of a reading sensor 36 disposed behind the imaging lens 35, and read as an image signal by the reading sensor 36.

Figure 8:
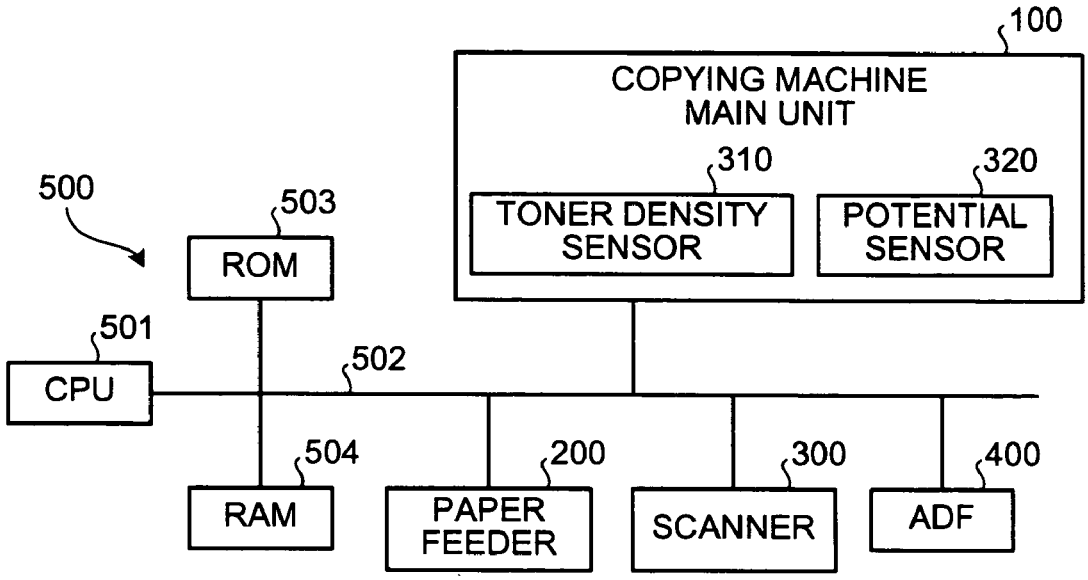
FIG. 8 is a block diagram of the copying machine.

FIG. 8 is a block diagram of the copying machine according to the first embodiment. The copying machine has a main controlling unit 500 configured by a computer, and the mail controller 500 controls driving of each part. The main controlling unit 500 has a CPU that executes various operations and driving control of each part, and a ROM (read only memory) 503 that stores solid data such as computer programs in advance and a RAM (random access memory) 504 that serves as a work area for storing various data in a rewritable manner connected to the CPU 501 via a bas line 502.

The ROM 53 stores a conversion table (not shown) on which information about conversion from output value of the toner density sensor 310 to toner adhesion amount per unit area is stored.

To the main controlling unit 500, each part of the copying machine main unit 100, the paper feeder 200, the scanner 300 and the auto document feeder 400 are connected. The toner density sensor 310 and the potential sensor 320 of the copying machine main unit 100 send the detected information to the main controlling unit 500.

Next, operation of the copying machine according to the first embodiment will be explained. When a duplicate of a document is to be created by using the copying machine having the above configuration, first a document is placed on a document holder 30 of the auto document feeder 400. Alternatively, a document may be placed on the contact glass 31 of the scanner 300 by opening the auto document feeder 400, and the document may be held down by closing the auto document feeder 400. Thereafter, when the user presses a starting switch (not shown), the document is conveyed on the contact glass 31 when the document is placed on the auto document feeder 400. Then the scanner 300 is driven and the first running member 33 and the second running member 34 start running. As a result, the light from the first running member 33 is reflected by the document on the contact glass 31, and the reflection light is reflected by the mirror of the second running member 34 and introduced to the reading sensor 36 via the imaging lens 35. In this manner, image information of the document is read out.

Also, when the user presses the starting switch, the driving motor (not shown) drives one of the supporting rollers 14, 15, and 16 so that the intermediate transfer belt 10 is driven. Simultaneously, the respective photoconductor drums 20Y, 20C, 20M, and 20K of the image forming units 18Y, 18C, 18M, and 18K are also rotated. Thereafter, based on the image information read out by the reading sensor 36 of the scanner 300, the light exposure device 21 irradiates the photoconductor drums 20Y, 20C, 20M, and 20K of the image forming units 18Y, 18C, 18M, and 18K with the writing beam. As a result, an electrostatic latent image is formed on each of the photoconductor drums 20Y, 20C, 20M, and 20K, and then visualized by the respective developers 61Y, 61C, 61M, and 61K. Thus, toner images of yellow, cyan, magenta and black are respectively formed on the photoconductor drums 20Y, 20C, 20M, and 20K.

The toner images of each color thus formed are sequentially and individually subjected to primary transferring by the respective primary transfer devices 62Y, 62C, 62M, and 62K so that they overlap with each other on the intermediate transfer belt 10. As a result, a combined toner image wherein toner images of each color overlap with each other is formed. The toner remaining after transfer on the intermediate transfer belt 10 after secondary transferring is eliminated by the belt cleaner 17.

Also when a user presses the starting switch, the paper feeding roller 42 of the paper feeder 200 corresponding to the transfer paper 5 selected by the user rotates, and the transfer paper 5 is sent out of one of the paper feeding cassettes 44. The sent out transfer paper 5 is separated to a single sheet by the separating roller 45 and enters the paper feeding path 46 where it is conveyed to the conveying path 48 in the copying machine main unit 100 by means of the conveying roller 47. The transfer paper 5 thus conveyed comes into abutment with the registration roller 49*b* and stops. When the transfer paper 5 that is not placed in the paper feeding cassette 44 is used, the transfer paper 5 that is placed on the manual feeding tray 6 is sent by the paper feeding roller 50 and separated to a single sheet by the separating roller 52, and then conveyed along the manual paper feeding path 53. Then similarly the transfer paper 5 comes into abutment with the registration roller 49*b* and stops.

The registration roller 49*b* start rotating in timing with that the combined toner image formed on the intermediate transfer belt 10 as described above is conveyed to the secondary transferring part opposing to the secondary transfer roller 24. The registration roller 49*b* is generally used while being earthed; however, it may be applied with a bias so as to remove paper powder of the transfer paper 5. The transfer paper 5 sent out by the registration roller 49*b* is then fed between the intermediate transfer belt 10 and the secondary transfer roller 24, and the combined toner image on the intermediate transfer belt 10 is secondarily transferred onto the transfer paper 5 by means of the secondary transfer roller 24. Thereafter, the transfer paper 5 is conveyed to the fixing device 25 while adsorbing to the secondary transfer roller 24, and then the toner image is subjected to fixing process by application of heat and pressure by the fixing device 25. The transfer paper 5 having passed through the fixing device 25 is then discharged to the paper discharge tray 7 by the discharging roller 56 in a stacking manner. In this connection, when an image is to be formed on the reverse side of the surface on which the toner image has been fixed, the conveying direction of the transfer paper 5 having passed through the fixing device 25 is switched by means of the switching claw 55 and the transfer paper is fed into the paper inversing device 93. The transfer paper 5 is inversed at this device and introduced again to the secondary transfer roller 24.

Figure 9:
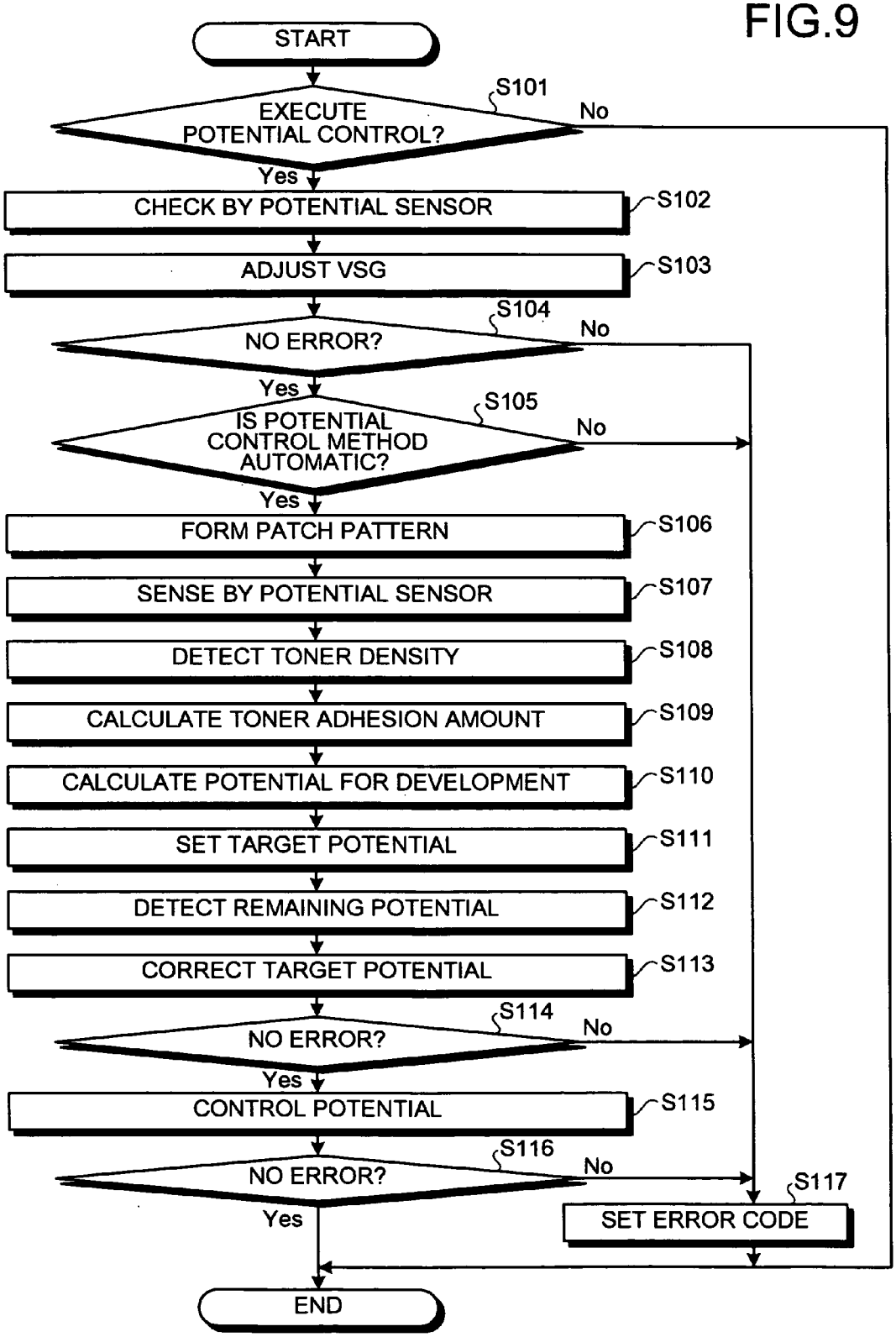
FIG. 9 is a flowchart of a potential control routine.
Figure 10:
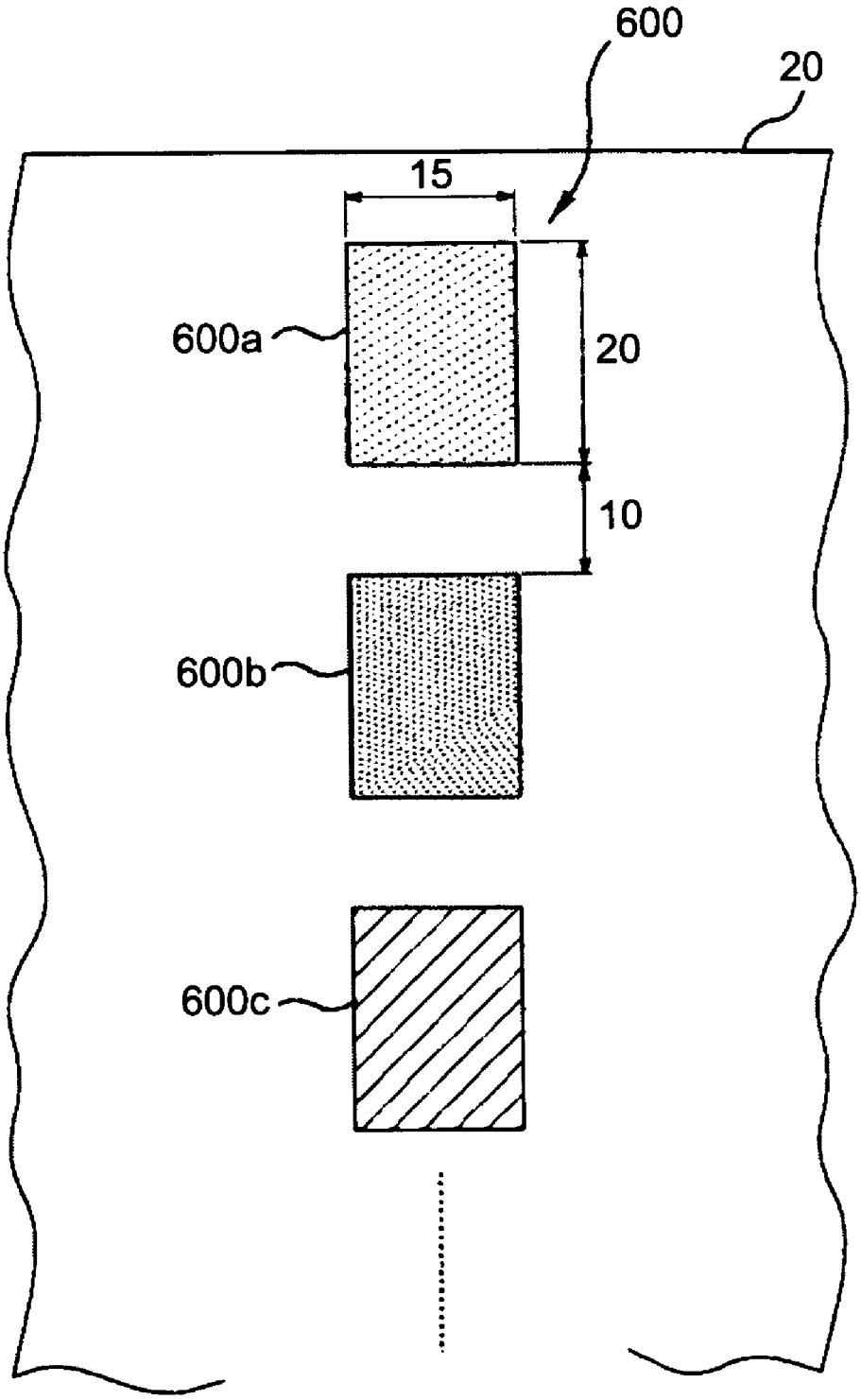
FIG. 10 is an explanatory view of patch patterns to be formed on the photoconductor drum.
Figure 11:
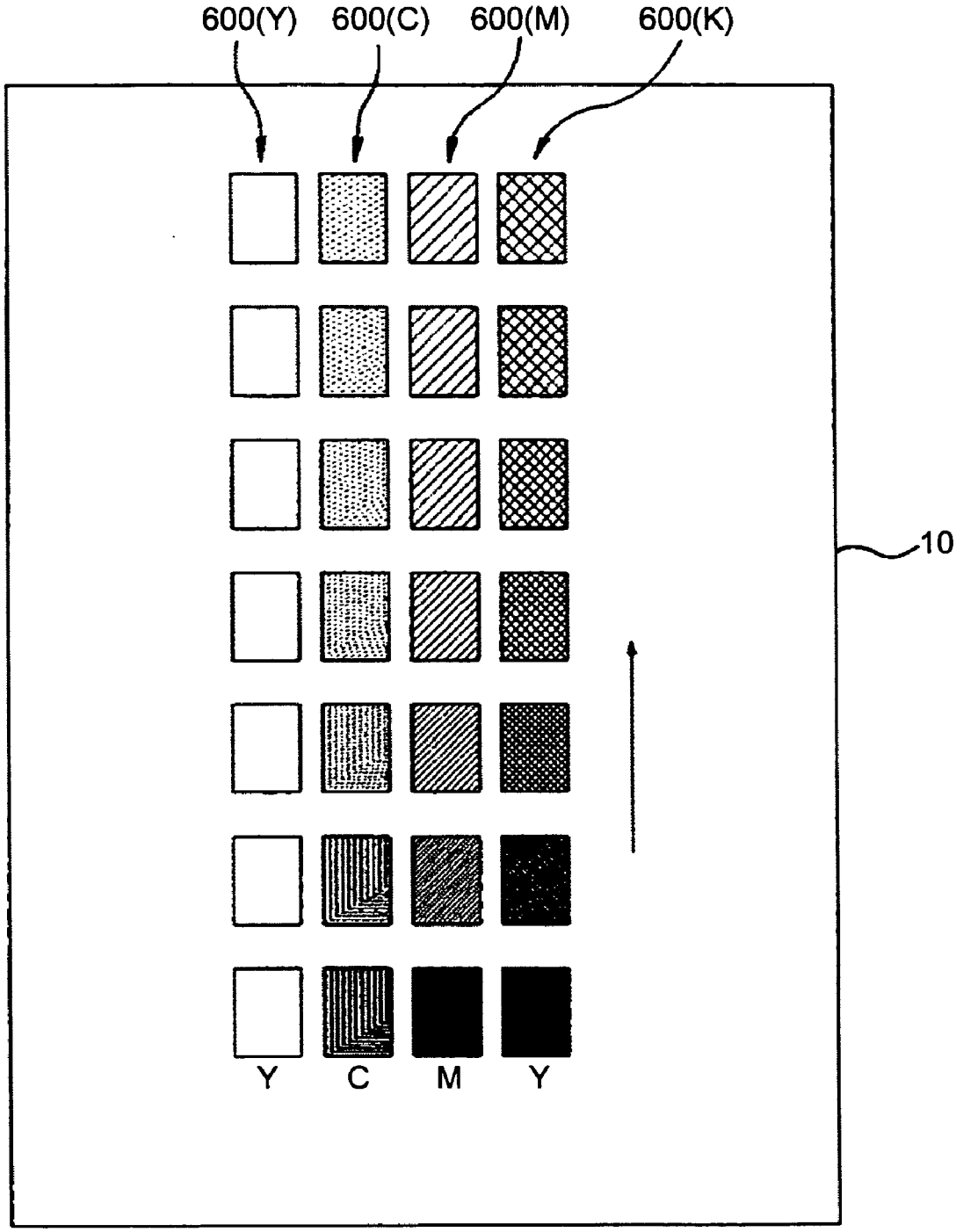
FIG. 11 is an explanatory view of patch patterns to be transferred onto the intermediate transfer belt.
Figure 12:
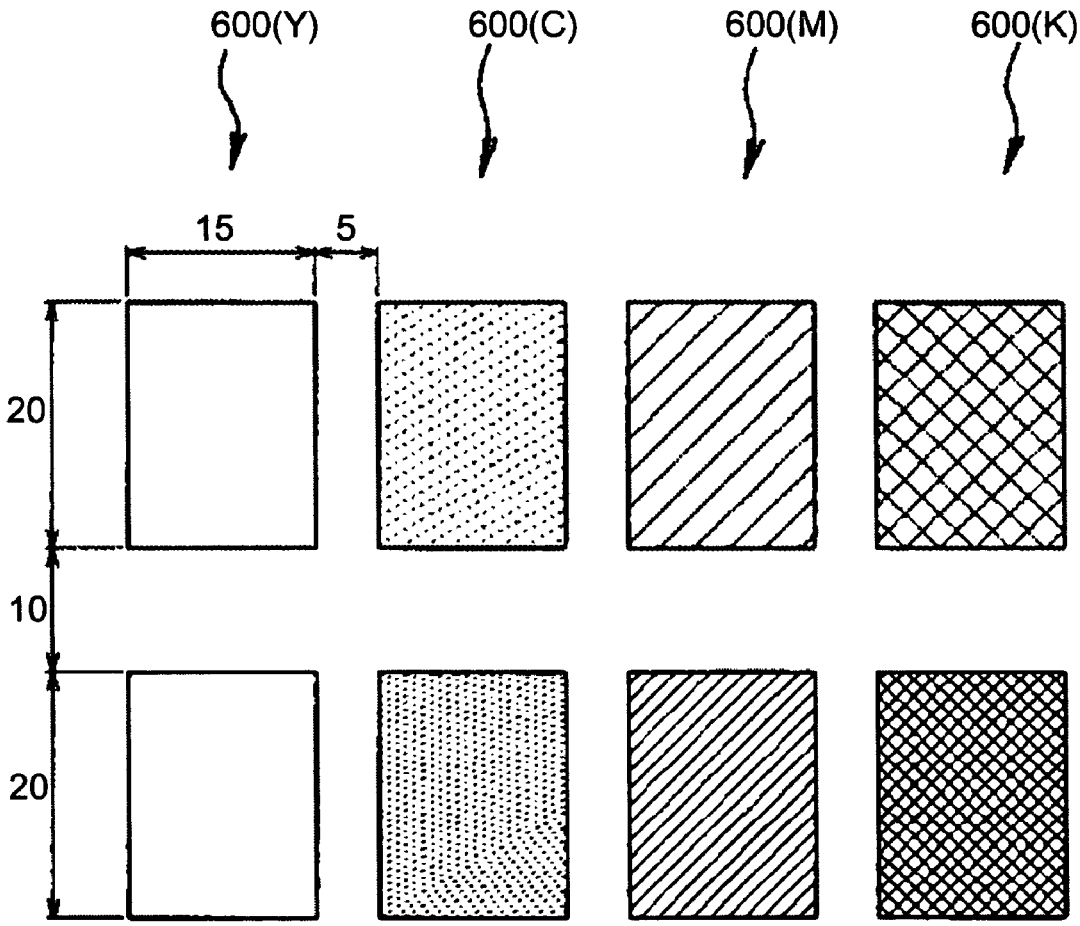
FIG. 12 is an enlarged view depicting the same patch patterns.
Figure 13:
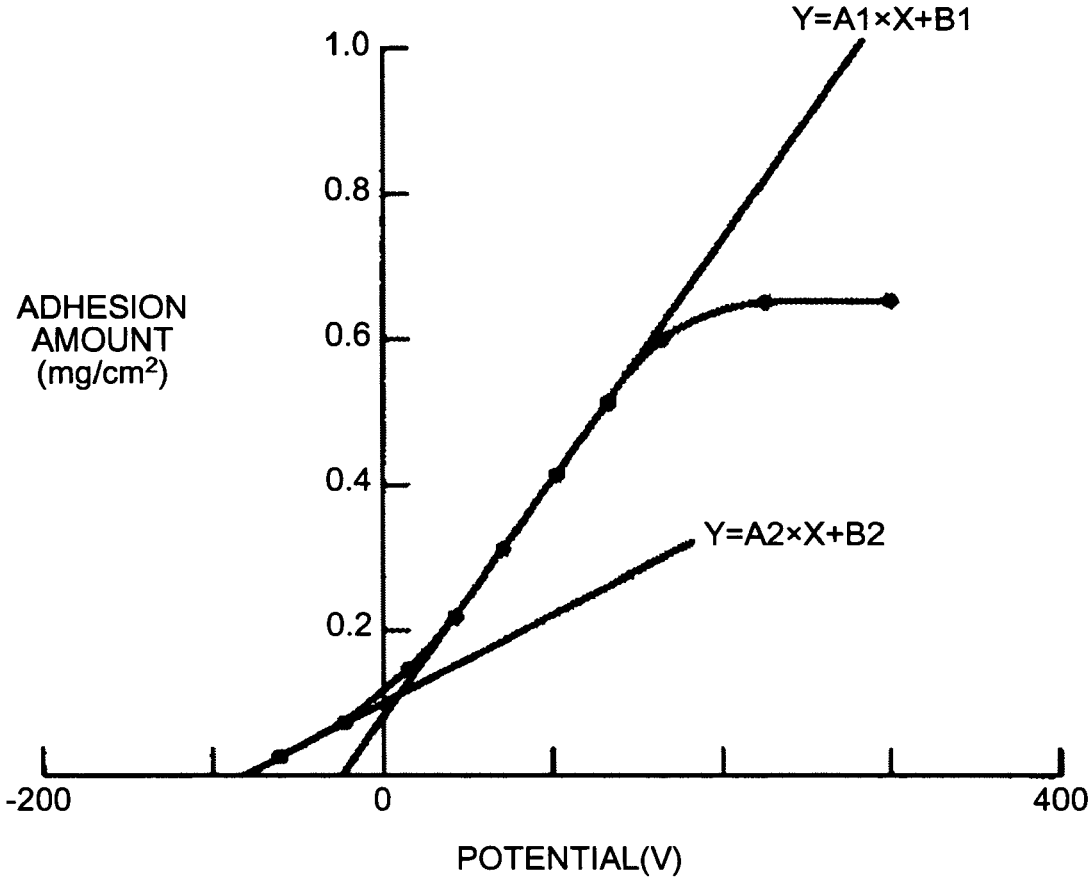
FIG. 13 is graph representing relationship between potential data and toner adhesion amount data in each patch pattern under the potential control.
Figure 14:
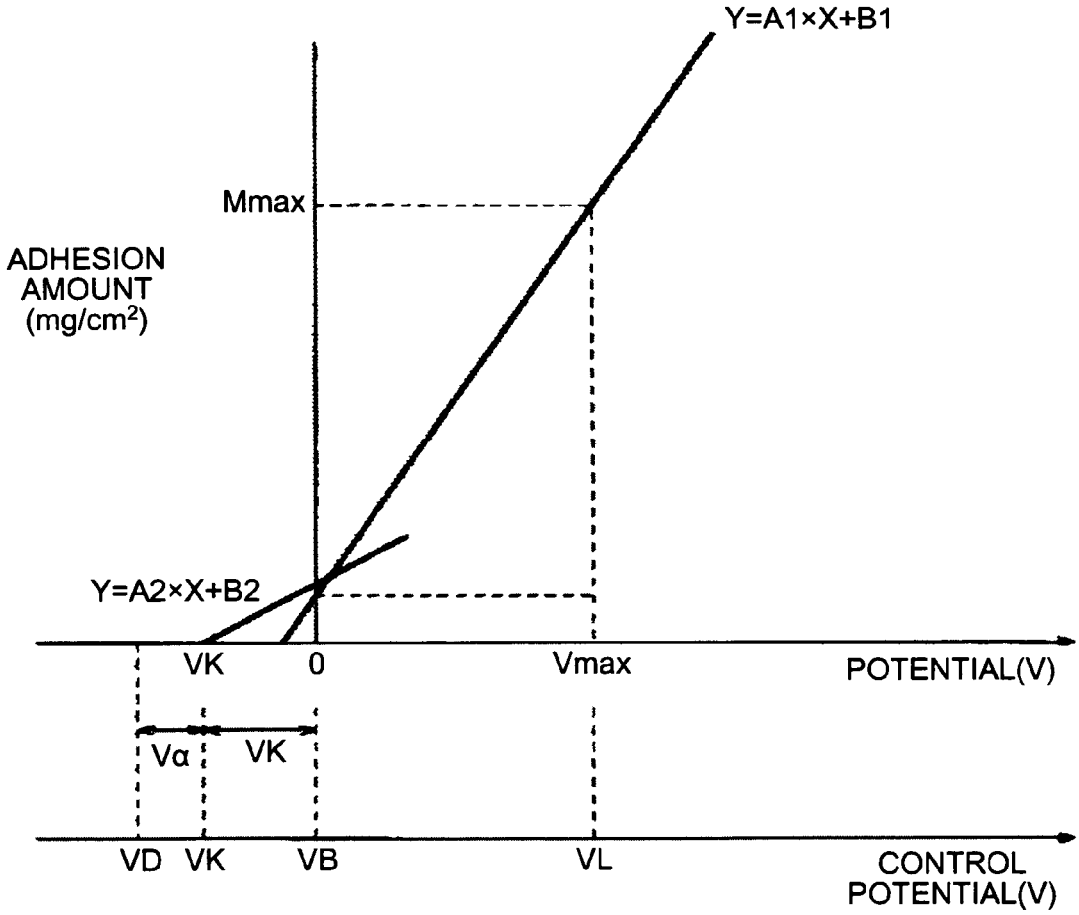
FIG. 14 is a graph of collinear approximation of potential data and control potential data with regard to toner adhesion amount data under potential control.

Next, with reference to FIGS. 9 to 15, explanation will be given about an image density control conducted based on a computer program by the CPU 501 of the first embodiment, which is a self-check potential control processing. FIG. 9 is a flowchart of the potential control routine, FIG. 10 is an explanatory view for patch patterns formed on the photoconductor drum 20, FIG. 11 is a plan view of the patch patterns transferred onto the intermediate transfer belt 10, FIG. 12 is an enlarged view of the patch patterns, FIG. 13 is a graph of relationship in each patch pattern between the potential data and toner adhesion data under potential control, FIG. 14 is a graph of collinear approximation of potential data and control potential data with regard to toner adhesion amount data under potential control, and FIG. 15 is a schematic view of a potential control table.

The potential control routine shown in FIG. 9 is basically executed at the startup of the copying machine, whenever a certain number of copies are made (between imaging operations during continuous imaging operation), and whenever a certain time is elapsed. In this description, operation at the time of startup will be explained. First, in order to distinguish the condition when the power is turned ON from the condition when abnormality such as jamming is to be processed, the fixing temperature of the fixing device 25 is detected as an execution condition of the potential control in step S101. Based on an input signal from the fixing temperature sensor, whether the fixing temperature of the fixing device 25 is more than 100° C. determined. When the fixing temperature of the fixing device 25 is more than 100° C.

("No" in step S101), it is determined that abnormality occurs and the processing ends without executing the potential control.

When the fixing temperature of the fixing device 25 is not more than 100° C. ("Yes" in step S101), the surface potential of each photoconductor drum 20 uniformly charged at a predetermined condition is checked by the potential sensor 320 (step S102), and then Vsg adjustment is conducted in step S103 (step S103). In this Vsg adjustment, light emission amount of the toner density sensor 310 is adjusted so that the irradiation light to the face of the photoconductor drum 20 from the toner density sensor 310 is reflected at a constant value by capturing an output value with respect to the face (surface) of the photoconductor drum 20 from the toner density sensor 310. In steps S102 to S103, the processing is conducted in parallel in the image forming units 18 for respective colors.

In step S104, whether abnormality occurs in the processes of step S102 to S103 is checked. When abnormality is found ("No" in step S104), the flow proceeds to step S117 where an error code is set and the processing ends.

In step S104, when it is determined that there is no abnormality in the processes of steps S102 to S103 ("Yes" in step S104), whether the selected method for the potential control is "automatic" or "fixed" is determined (step S105).

In steps S103 to S104, the operation is conducted prior to step S106 for use in other toner supply control and the like regardless of the potential control method.

When it is determined in step S105 that the potential control method is not an automatic but a fixed method ("No" in step S105), an error code is set in step S117 and the processing ends. On the other hand, when it is determined in step S105 that the potential control method is automatic method ("Yes" in step S105), the processes of step S106 to S107 are executed in parallel for the image forming units 18 of the respective colors.

In step S106, as shown in FIG. 5, patch patterns (latent image patterns) 600 serving as a reference toner patch which are toner images are formed on each photoconductor drum 20 (forming unit). The patch patterns 600 are formed while shifted by colors in the direction of axial centers 90 (width direction) of the photoconductor drums 20. In the first embodiment, N patch patterns 600 (600*a*, 600*b*, 600*c*, . . . ) which are electrostatic latent images having N gradation densities as shown in FIG. 10 for each color are formed at a certain interval along the rotation direction of the photoconductor drum 20. In the first embodiment, rectangular patch patterns 600 (600*a*, 600*b*, 600*c*, . . . ) of 15×20 mm having different 16 gradation densities are formed at an interval of 10 mm along the rotation direction of the photoconductor drum 20. The distance between these patch patterns 600 for each color in the direction of axial centers 90 of the photoconductor drums 20 is 5 mm.

By forming the patch patterns 600 in the manner as described above, it is possible to form the patch patterns 600 for each color on the intermediate transfer belt 10 while preventing them from overlapping with each other, as shown in FIG. 11 when the patch patterns 600 are transferred onto the intermediate transfer belt 10. FIG. 12 is an enlarged view of the patch patterns 600 on the intermediate transfer belt 10.

In next step S107, output values from the potential sensor 320 for the potentials of the patch patterns 600 (600*a*, 600*b*, 600*c*, . . . ) on the photoconductor drum 20 are read and stored in the RAM 504. Then the black developer 61K, cyan developer 61C, magenta developer 61M and yellow developer 61Y are made to develop the patch patterns 600 for four colors on the photoconductor drums 20 and visualize the same, whereby toner images for each color are obtained.

Then, the CPU 501 executes detection of toner density for the patch patterns 600 of the photoconductor drum 20 by means of the toner density sensor 310 (step S108). In this detection of toner density, output values of the toner density sensor 310 for the patch patterns 600 which are toner images for each color are stored in the RAM 504 as Vpi (i=1 to N) for each color.

Next, adhesion amount of toner is calculated (step S109). That is, output values of the toner density sensor 310 stored in the RAM 504 are converted to toner adhesion amounts per unit area while looking up the conversion table stored in the ROM 503 and the conversion results are stored again in the RAM 504. Then steps S110 to S112 are executed. In the following, these steps are explained in detail.

FIG. 13 represents relationship between potential data obtained in step S107 and toner adhesion data obtained in step S109 in each of the patch patterns 600 (600*a*, 600*b*, 600*c*, . . . ) plotted on the X-Y plane. The X axis represents potential (difference between developing bias potential VB and surface potential of the photoconductor drum 20) (unit: volt), and the Y axis represents toner adhesion amount per unit area (mg/cm$^2$). In the first embodiment, the toner density sensor 310 is implemented by an infrared light reflective type sensor based on the optical system as described above. Since an infrared light reflective type sensor generally shows saturation characteristic at a dense adhesion part where a large amount of toner adheres, as shown in FIG. 13, the obtained detection values no longer reflect the actual toner adhesion amounts in such a dense adhesion part. Therefore, when a toner adhesion amount is calculated by directly using a detection value from the toner density sensor 310 obtained in a dense adhesion part, an adhesion amount that is different from the actual adhesion amount is obtained, which disables accurate execution of the toner supply control based on the toner adhesion amount.

For addressing this problem, in the CPU 501 according to the first embodiment, for the patch patterns 600 (600*a*, 600*b*, 600*c*, . . . ) of each color, potentials of the patch patterns 600 (600*a*, 600*b*, 600*c*, . . . ) obtained from the potential sensor 320 and the toner density sensor 310, and data of toner adhesion amount after visualization are picked out only in the interval where the relationship between potential data Xn (n=1 to 10) and toner adhesion data Yn (development γ characteristic) is linear as described below, and the data falling within this interval is subjected to least square method, to thereby conduct collinear approximation of the development characteristic of each developer 61 in the manner as will be described below. An approximate linear equation (E) of development characteristic is obtained for each color, and a control potential is calculated for each color using this approximate linear equation (E).

Calculation of least square method uses the following equations:

$$Xave=\Sigma Xn/k \quad (1)$$

$$Yave=\Sigma Yn/k \quad (2)$$

$$Sx=\Sigma(Xn-Xave)\times(Xn-Xave) \quad (3)$$

$$Sy=\Sigma(Yn-Yave)\times(Yn-Yave) \quad (4)$$

$$Sxy=\Sigma(Xn-Xave)\times(Yn-Yave) \quad (5)$$

When the approximate linear equation (E) established from the potentials of the patch patterns 600 (600*a*, 600*b*, 600*c*, . . . ) obtained by the potential sensor 320 and the toner density sensor 310, and the data of toner adhesion amount after visualization is represented by Y=A1×X+B1, coefficients A1 and B1 can be expressed by the following equations using the above variables:

$$A1=Sxy/Sx \quad (6)$$

$$B1=Yave-A1\times Xave \quad (7)$$

And correlation coefficient R of the approximate linear equation (E) can be expressed by:

$$R\times R=(Sxy\times Sxy)/(Sx\times Sy) \quad (8)$$

In the first embodiment, the CPU 501 picks out five sets of data in ascending order of Yn value, each set consisting of potential data Xn of the patch patterns 600 (600*a*, 600*b*, 600*c*, . . . ) obtained from the potential sensor 320 and the toner density sensor 310 for each color until step S109, and data of toner adhesion amount after visualization Yn:

(X1 to X5, Y1 to Y5)
(X2 to X6, Y2 to Y6)
(X3 to X7, Y3 to Y7)
(X4 to X8, Y4 to Y8)
(X5 to X9, Y5 to Y9)
(X6 to X10, Y6 to Y10)

Then the CPU 501 makes collinear approximation in accordance with the above equations (1) to (8) and calculates the correlation coefficient R, to obtain six sets of approximate linear equation and correlation coefficients (9) to (14) as follows:

$$Y11=A11\times X+B11;R11 \quad (9)$$

$$Y12=A12\times X+B12;R12 \quad (10)$$

$$Y13=A13\times X+B13;R13 \quad (11)$$

$$Y14=A14\times X+B14;R14 \quad (12)$$

$$Y15=A15\times X+B15;R15 \quad (13)$$

$$Y16=A16\times X+B16;R16 \quad (14)$$

The CPU 501 selects as the approximate linear equation (E) one set of approximate linear equation corresponding to the maximum value of the correlation coefficients R11 to R16 from the obtained six sets of approximate linear equations.

Next, the main controlling unit 500 (CPU 501) calculates a value of X where the value of Y is the necessary maximum toner adhesion amount Mmax as shown in FIG. 14, or a value of development potential Vmax in the selected approximate linear equation (E) for each color in step S110. The bias potential VB of each of the black developer 61K, cyan developer 61C, magenta developer 61M and yellow developer 61Y and the surface potential given by light exposure of each color image on the photoconductor drum 20 can be represented by the following equations (15) and (16) from the above equations:

$$V\text{max}=(M\text{max}-B1)/A1 \quad (15)$$

$$VB-VL=V\text{max}=(M\text{max}-B1)/A1 \quad (16)$$

The relationship between the VB and VL can be represented by using the coefficient of the approximate linear equation (E). Therefore, the equation (16) is $$M\text{max}=A1\times V\text{max}+B1 \quad (17)$$

The relationship between charge potential VD before light exposure of the photoconductor drum 20 and development bias potential VB can be obtained from an X coordinate of intersect VK (development starting voltage of the developer 61) between the linear equation shown in FIG. 14, $$Y=A2\times X+B2 \quad (18)$$

and the X axis, and from a background margin voltage Vα that is experimentally determined, by the following equation:

$$VD-VB=VK+V\alpha \quad (19)$$

Therefore, the relationship between Vmax, VD, VB, and VL is determined by the equations (16) and (19). In this example, relationships between Vmax which is a reference and each control voltage VD, VB, and VL are determined in advance by experiments and the like, and the determined relationships are stored in the ROM, 503 by a potential control table T1 as shown in FIG. 15.

Then, the CPU 501 selects a Vmax which is nearest to the Vmax calculated for each color from the potential control table T1 in step S111, and sets each control voltage VB, VD, VL corresponding to the selected Vmax as a target potential.

Next, in step S111, the semiconductor laser is controlled so that the laser emission power is maximum light intensity via the laser controller of the light exposure device 21, and output values of the potential sensor 320 are captured, whereby the remaining potential of the photoconductor drum 20 is detected (step S112). Then in step S113, when the remaining potential is not 0, the target potentials VB, VD, VL determined in step S111 are corrected by that remaining potential, and set as new target potentials.

In step S114, whether there is an error in steps S105 to S113 is determined. When there is an error in only one color ("No" in step S114), even if controls are executed for other colors, the image density will significantly change and the operation subsequently executed in S115 will have no utility. Therefore, an error code is set (step S117) and the processing ends. In this case, the imaging condition is not renewed, and imaging is executed in the same condition as previously used until the self-check of the next time succeeds.

In step S114, when it is determined that there is no error ("Yes" in step S114), the power circuit (not shown) is adjusted so that the charge potential VD by the charger 60 of the photoconductor drum 20 becomes the above target potential in parallel manner for each color in step S115, and the light emission power in the semiconductor laser is adjusted via the laser controller (not shown) so that the surface potential VL of the photoconductor drum 20 becomes the above target potential, and the power circuit is adjusted so that the development bias potentials VB of the black developer 61K, cyan developer 61C, magenta developer 61M and yellow developer 61Y become respective target potentials (image density controlling unit).

Then in step S116, whether there is an error in step S115 is determined. When there is no error in step S115 ("Yes" in step S116), the processing ends. On the other hand, when there is an error in step S115 ("No" in step S116), the flow proceeds to step S117 where an error code is set, and the processing ends.

The potential control as described above is important control especially in a color image forming apparatus for keeping the image quality constant.

Then the patch patterns 600 (600*a*, 600*b*, 600*c*, . . . ) of each color on the respective photoconductor drums 20 formed in such a potential control processing are transferred so that the patch patterns 600 of each color do not overlap with each other on the intermediate transfer belt 10 as shown in FIG. 11.

As described above, in the first embodiment, since the patch patterns 600 corresponding to each photoconductor drum 20 for conducting the potential control which is the image density control are transferred onto the intermediate transfer belt 10 so as not to overlap with each other as shown in FIG. 11, loads on the belt cleaner 17 and the roller cleaning part 91 are lightened, so that it is possible to prevent the toner from scattering due to insufficient cleaning or transfer spattering during each transfer process. Furthermore, since the patch patterns 600 can be formed in parallel on each photoconductor drum 20, it is possible to reduce the user's waiting time required for execution of the potential control.

Furthermore, in the potential control which is a self check, since cleaning deficiency is prevented in the belt cleaner 17 or the roller cleaning part 91, it is possible to conduct the usual image formation following the self check.

Furthermore, by conducting the formation of the toner patches in the potential control between imaging operations during continuous imaging operation for transfer to a plurality of recording media, it is possible to conduct image density control without necessity to provide a special time for image density control.

In the first embodiment, explanation is given while taking a copying machine as an example for the image forming apparatus, however, the image forming apparatus may be a printer or the like without limited to the copying machine.

In the first embodiment, explanation is given while exemplifying the case where all the toner density sensor 310 and all the patch patterns 600 for each color are arranged while shifted from each other in the direction of axial centers 90 of the photoconductor drums 20, however the present invention is not limited to this, but only at least two toner density sensors 310 and the patch patterns 600 corresponding to these toner density sensors 310 may be arranged while shifted from each other in the direction of axial centers 90 of the photoconductor drums 20. For example, only the black toner density sensor 310 and the black patch patterns 600 corresponding to this may be shifted from the toner density sensors 310 and the patch patterns 600 of other colors. In this case, cleaning load on the intermediate transfer belt 10 for color toner increases compared to the case where all the toner density sensors 310 and the toner patches 60 are shifted in the direction of the axial centers 90. However, even in such a case, it is possible to decrease the cleaning load on the intermediate transfer belt 10 compared to the case where all the toner density sensors 310 are located at the same position with regard to the direction of the axial center 90 and all the toner patches 600 are correspondingly located at the same position in the direction of axial centers 90. Generally, color images are less frequently outputted than monochrome images. Therefore, by employing different controls between monochrome images and color images so that cleaning is sufficiently executed by spending a time only in color adjustment of color images, the apparatus will be adequately useful. Also this approach is advantageous in that the change in color density depending on the position of the toner patches 600 can be reduced.

Next, working example of the present invention will be explained. In this example, an attempt is made to miniaturize the toner density sensor 310 so as to place the toner density sensor 310 on the tandem type photoconductor drum 20. It is important for this miniaturization that to what degree the constituents of the light receiving/emitting elements can be miniaturized. Generally, the smaller the light receiving/emitting elements, the worse the light emitting intensity and light receiving sensitivity (S/N) become. For addressing this problem, in the present example, the degree of brilliancy GS(20) is set to more than 90. Also, in this example, the degree of brilliancy of the surface of the intermediate transfer belt is set to less than or equal to 80.

In the present example, the photoconductor drum 20 and the intermediate transfer belt are driven at a surface line speed ratio of approximately 1.

Furthermore, in the present example, in order to ensure the space for locating the toner density sensor 310, the developing sleeve 65 is placed about 10 degrees above the horizontal line passing the axial center 90 of the photoconductor drum 20.

In the present example, in order to process the outputs of the potential sensor 320 and the toner density sensor 310 in parallel for four colors, A/D having a sampling cycle of 4 milliseconds (msec) is independently used for each channel.

Also in the present example, in order to minimize the variation difference at the detection position, the patch patterns 600 of each color that are a reference toner patch are made close to each other, and concentrated to the center of the axial center 90 of the photoconductor drum 20, concretely, within the A6 width.

When such a configuration is employed, since the degree of brilliancy of the surface of the photoconductor drum 20 is higher than the degree of brilliancy of the surface of the intermediate transfer belt 10, it is possible to detect the toner density more stably than the case where the toner density is detected on the intermediate transfer belt 10.

Also since the degree of brilliancy of the surface of the intermediate transfer belt 10 is less than or equal to 80, it is possible to detect the toner density more stably than the case where the toner density is detected on the intermediate transfer belt 10.

Furthermore, since degree of brilliancy of the surface of the photoconductor drum 20 GS (20) is more than 90, and S/N of the toner density sensor 310 can be kept high, it is possible to adopt light receiving/emitting element that are smaller than the conventional ones, and it is possible to dispose the toner density sensor 310 so as to oppose to the photoconductor drum even in the case of tandem type apparatus.

Furthermore, since the line velocity ratio between the surfaces of the photoconductor drum 20 and the intermediate transfer belt 10 is approximately 1, the intermediate transfer belt 10 is unlikely to rub against the surface of the photoconductor drum 20 to make a flaw, so that is it is possible to realize more stable detection compared to the intermediate transfer belt 10 whose surface condition is impaired by rubbing against the transfer paper 5.

Furthermore, the toner density sensors 310 are arranged so that they concentrates as a whole around the center of the direction of the axial center 90 of the photoconductor drum 20 and the width thereof falls within the width of A6. Since images usually outputted are larger than A6 width, by adopting the above configuration, it is possible to provide a copying machine with less variation in position of the patch patterns 600 of each color, less detection errors for each color depending on the detection position, and high performance and high accuracy.

Among the toner density sensors 310, when only the black toner density sensor 310 is shifted in the direction of axial centers 90 from the toner density sensors 310 of other colors, and other toner density sensors 310 are aligned in the direction of axial center, and correspondingly only the black toner patch 600 is shifted from other toner patches 600 in the direction of axial centers 90, the error depending on the detection positions of color toner is avoided although the time for cleaning the intermediate transfer belt 10 is longer than the case where all the toner density sensors 310 and the toner patches 60 are shifted from each other in the direction of axial centers 90. Also the cleaning load on the intermediate transfer belt 10 is reduced and the color reproducibility is improved compared to the case where all the toner patches 600 are in the same position with regard to the direction of the axial center 90.

According to the present invention, when reference toner patches which are toner images for conducting image density control are formed for each image bearing member so that a plurality of detectors can detect their density, at least two reference toner patches may be formed so as to be shifted from each other in the direction of axial centers of the image bearing members in correspondence with the detectors. Since at least two reference toner patches are transferred onto the intermediate transfer belt while shifted from each other, it is possible to reduce the toner scattering due to cleaning deficiency at the intermediate transfer cleaning and the secondary transfer cleaning, as well as transfer spattering in each transfer process, compared the case where all the detectors are disposed at the same position in the direction of axial centers of the image bearing members.

Furthermore, according to the present invention, in an image forming apparatus that obtains a color image by forming toner images on a plurality of image bearing members rotationally driven, and transferring the toner images to an intermediate transfer member, a plurality of detectors may be provided for each image bearing member and disposed so as to oppose to the respective image bearing members, and at least two of which are shifted from each other in the direction of axial centers of the image bearing members, for optically detecting density of the toner images formed on the opposite image bearing members. In this case when reference toner patches which are toner images for conducting image density control are formed for each image bearing member so that the detectors can detect the density, at least two reference toner patches corresponding to the detectors may be formed so as to be shifted from each other in the direction of axial centers of the image bearing members. Since at least two reference toner patches are transferred onto the intermediate transfer belt while shifted from each other, it is possible to reduce the toner scattering due to cleaning deficiency at the intermediate transfer cleaning and the secondary transfer cleaning, as well as transfer spattering in each transfer process, compared the case where all the detectors are disposed at the same position in the direction of axial centers of the image bearing members. Furthermore, it is possible to reduce the cleaning load on the intermediate transfer belt compared to the case where all the detectors are disposed at the same position in the direction of axial centers of the image bearing members. Also since reference toner patches can be formed in parallel on the respective image bearing member, it is possible to reduce the waiting time of user in executing the self-check such as potential control.

According to the present invention, in an image forming apparatus that obtains a color image by forming toner images on a plurality of image bearing members rotationally driven, and transferring the toner images to an intermediate transfer member, a plurality of detectors are provided for each image bearing member so as to oppose to the same and disposed while shifted in the direction of axial centers of the image bearing members, for optically detecting density of the toner image formed on the opposite image bearing member. In this case, reference toner patches which are toner images for conducting image density control may be formed for each image bearing member while shifted in the direction of axial centers of the image bearing members so that the detectors can detect the density. Since toner patches corresponding to the respective image bearing members are transferred onto the intermediate transfer belt while shifted from each other, it is possible to reduce the toner scattering due to cleaning deficiency at the intermediate transfer cleaning and the secondary transfer cleaning, as well as transfer spattering in each transfer process. Furthermore, since reference toner patches can be formed in parallel on the respective image bearing member, it is possible to reduce the use's waiting time required for executing the self-check such as potential control.

According to the first embodiment, since a reference patch forming unit that forms reference toner patches which are toner images for each image bearing member so that a plurality of detectors can detect the density, and an image density controlling unit that executes image density control based on detection results of the detectors are provided, at least two reference toner patches corresponding to each image bearing member for executing image density control are formed so as to correspond to the detectors while shifted from each other in the direction of axial centers of the image bearing members and hence transferred onto the intermediate transfer belt while shifted from each other, it is possible to reduce the toner scattering due to cleaning deficiency at the intermediate transfer cleaning and the secondary transfer cleaning, as well as transfer spattering in each transfer process, compared the case where all the toner patches are disposed at the same position in the direction of axial centers of the image bearing members.

Furthermore, according to the first embodiment, since a reference patch forming unit that forms reference toner patches which are toner images for each image bearing member so that a plurality of detectors can detect the density in the condition that they are shifted in the direction of axial centers of the image bearing members, and an image density controlling unit that executes image density control based on detection results of the detectors are provided, the reference toner patches corresponding to each image bearing member for executing image density control are transferred onto the intermediate transfer belt while shifted from each other, it is possible to prevent the toner scattering due to cleaning deficiency at the intermediate transfer cleaning and the secondary transfer cleaning, as well as transfer spattering in each transfer process. Furthermore, since reference toner patches can be formed in parallel on the respective image bearing member, it is possible to reduce the waiting time of user in executing the self-check such as potential control.

Furthermore, according to the first embodiment, since the detectors are arranged as a whole near the center in the direction of axial centers of the image bearing members, it is possible to suppress variation in image density among detectors caused by different manners of variation in image density depending on the position in the direction of axial centers of the image bearing member.

Furthermore, according to the first embodiment, since the reference patch forming unit forms the toner patches in the potential control between imaging operations during continuous imaging operation for transfer to a plurality of recording media, it is possible to conduct image density control without necessity to provide a special time for image density control.

Furthermore, according to the first embodiment, since the degree of brilliancy of the surface of the image bearing member is higher than the degree of brilliancy of the surface of the intermediate transfer belt, it is possible to detect the toner density more stably than the case where the toner density is detected on the intermediate transfer belt.

Furthermore, according to the first embodiment, since the degree of brilliancy of the surface of the intermediate transfer belt is less than or equal to 80, it is possible to detect the toner density more stably than the case where the toner density is detected on the intermediate transfer belt.

Furthermore, according to the first embodiment, since degree of brilliancy of the surface of the image bearing member is more than 90, and S/N of the toner density sensor can be kept high when a reflective type optical sensor is used as the detector, it is possible to adopt light receiving/emitting element that are smaller than the conventional ones, and it is possible to dispose the detector so as to oppose to the image bearing member even in the case of tandem type apparatus.

Furthermore, according to the first embodiment, since the line velocity ratio between the surfaces of the image bearing member and the intermediate transfer belt is approximately 1, the intermediate transfer belt is unlikely to rub against the surface of the image bearing member to make a flaw, so that is it is possible to realize more stable detection compared to the intermediate transfer belt whose surface condition is impaired by rubbing against the transfer paper.

Next a second embodiment of the present invention will be explained with reference to drawings. The second embodiment is an example of the image forming apparatus applied to a full-color electrophotographic copying machine of tandem type (hereinafter, "copying machine").

The entire configuration of the copying machine according to the second embodiment is as same as that described for the first embodiment shown in FIG. 1, and hence explanation thereof will be omitted.

The explanation about the copying machine main unit 100 will be omitted since it is as same as the explanation of the first embodiment shown in FIG. 2.

Explanation about the copying machine main unit 100, configuration of image forming units, charger, developer, primary transferring device, photoconductor cleaner and charge eliminator will be omitted because they are as same as those described for the first embodiment with reference to FIGS. 2 to 4.

Figure 16:
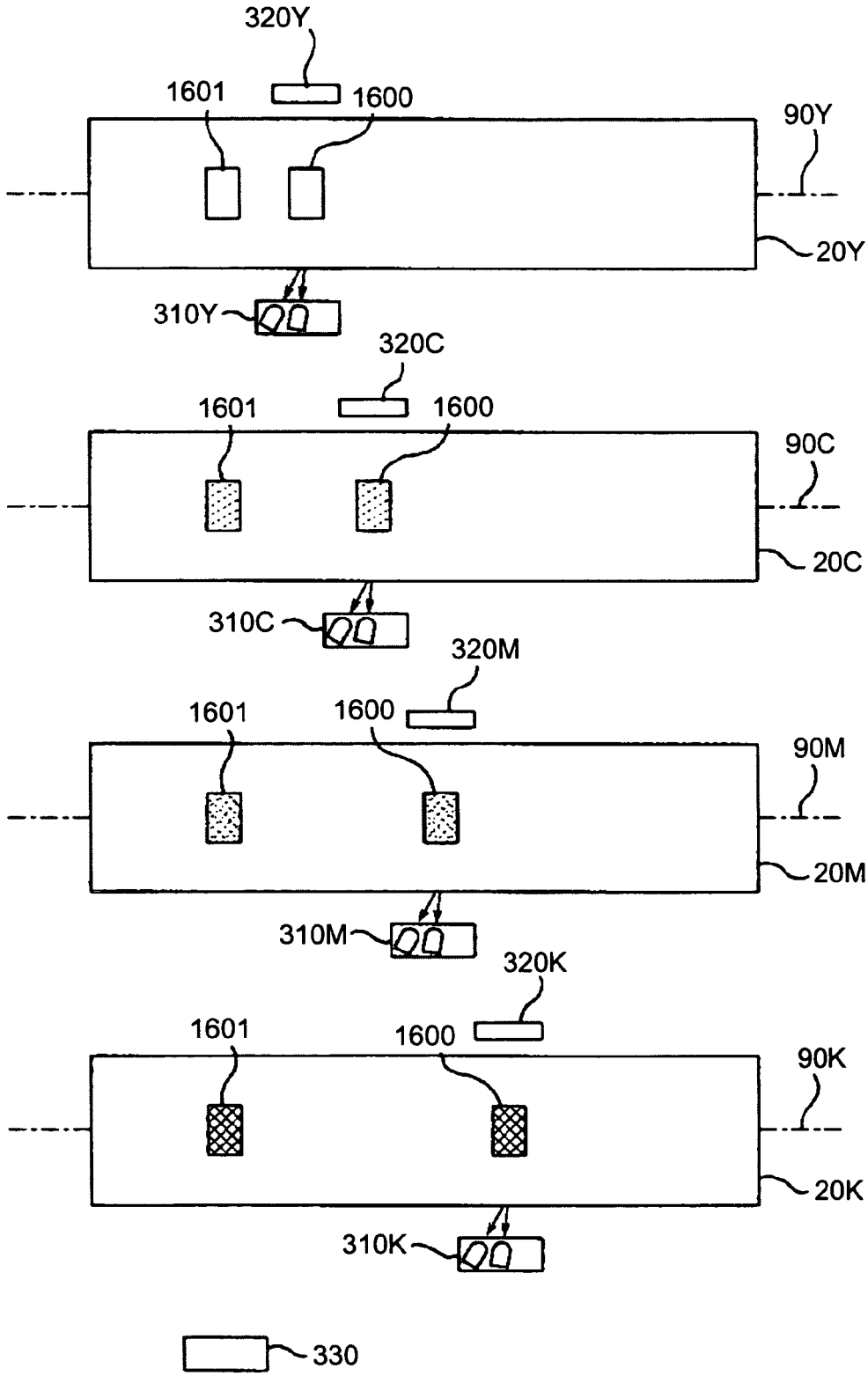
FIG. 16 is a plan view mainly depicting a toner density sensor, a potential sensor and a photoconductor included in a copying machine according to the second embodiment of the present invention.

The image forming unit 18 is provided with a toner density sensor 310 and a potential sensor 320 serving as the first detector in correspondence with each photoconductor drum 20. More specifically, as shown in FIG. 16, the toner density sensors 310 (310Y, 310C, 310M, and 310K) are provided for each photoconductor drum 20 so as to oppose to the respective photoconductor drums 20, and are shifted from each other in the direction of axial centers 90 of the photoconductor drums 20. The toner density sensor 310 is an infrared light reflective type sensor based on the optical system, and optically detects density of a toner image formed on the surface of the photoconductor 20. Also the potential sensors 320 (320Y, 320C, 320M, and 320K) are provided for each photoconductor drum 20 so as to oppose to the respective photoconductor drums 20, and are shifted from each other in the direction of axial centers 90 of the photoconductor drums 20. These potential sensors 320 detect potential of surface of the photoconductor drums 20. In the second embodiment, a development sleeve 65 for ensuring a space for locating the toner density sensor 310 (see FIG. 4) is disposed about 10 degrees above the horizontal line passing the axial center 90 of the photoconductor drum 20.

Explanation about concrete settings of the image forming unit 18, formation of electrostatic latent image, secondary transfer operation, configuration of conveyer belt between rollers and removal of remaining toner will be omitted because they are as same as those described for the first embodiment.

A correction sensor 330 serving as the second detector is provided in downstream side of all of the photoconductor drums 20 of the intermediate transfer belt 10 in the rotation direction of the intermediate transfer belt so as to oppose to the intermediate transfer belt 10. Concretely, the correction sensor 330 is disposed so as to oppose to the first supporting roller 14 via the intermediate transfer belt 10. The correction sensor 330 is an infrared reflective type sensor based on the optical system having the same configuration as the toner density sensor 310, and optically detects density of a toner image formed on the surface of the intermediate transfer belt 10. In FIG. 16, the correction sensor 330 is schematically illustrated for explaining positional relationship between the correction sensor 330 and the toner density sensors 310. As shown in FIG. 16, the correction sensor 330 is disposed while shifted from each of the toner density sensors 310Y, 310C, 310M and 310K in the direction of axial centers 90 of the photoconductor drums 20. Furthermore, the correction sensor 330 and each of the toner density sensors 310Y, 310C, 310M and 310K are arranged in the direction of axial centers 90 of the photoconductor drums 20 in the order of correction sensor 330, yellow toner density sensor 310Y, cyan toner density sensor 310C, magenta toner density sensor 310M and black toner density sensor 310K. That is, the correction sensor 330 and the black toner density sensor 310K are located at farthest positions in the direction of axial centers 90 of the photoconductor drums 20 among all of the toner density sensors 310 and the correction sensor 330.

In this description, the conveying path 48 of the copying machine main unit 100, the paper feeder 200 and the scanner 300 will be omitted since they are same as those described in the first embodiment shown in FIG. 1.

Next, brief explanation about the scanner 300 will be made based on FIG. 1. In the scanner 300, a first running member 33 and a second running member 34 on which a document lighting optical source and a mirror are mounted reciprocate so as to read and scan a document (not shown) placed on a contact glass 31. Image information scanned by these running members 33 and 34 is then focused by the imaging lens 35 onto the imaging surface of a reading sensor 36 disposed behind the imaging lens 35, and read as an image signal by the reading sensor 36.

Figure 17:
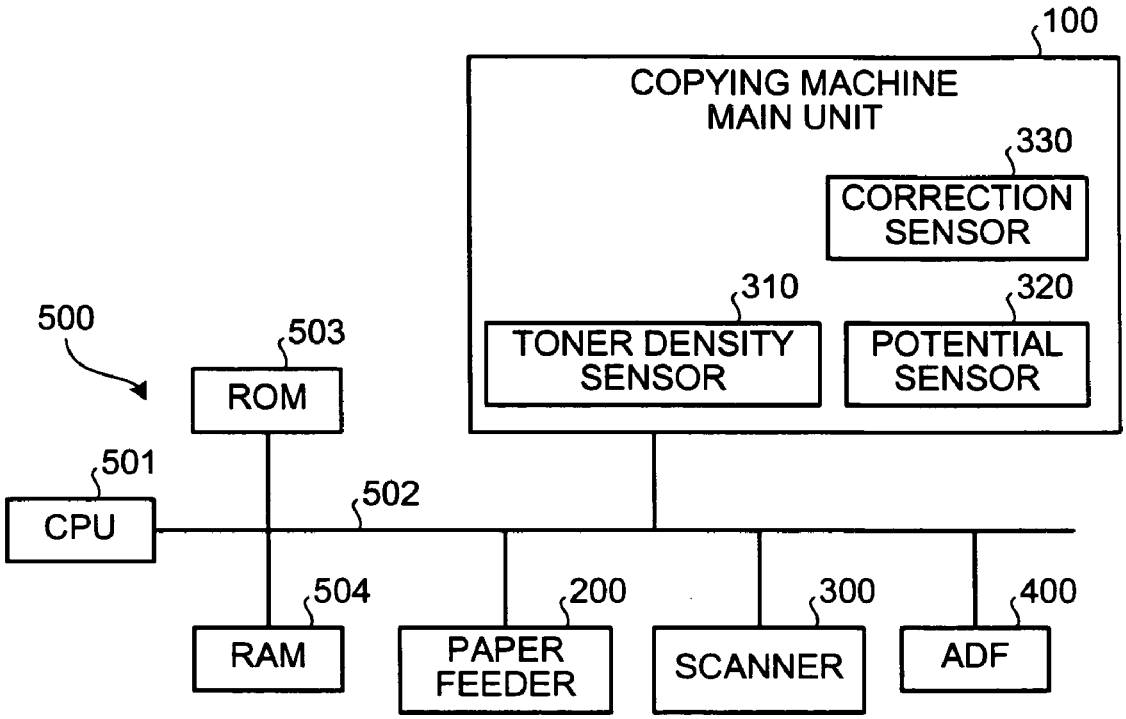
FIG. 17 is a block diagram of the copying machine.

FIG. 17 is a block diagram of the copying machine according to the second embodiment. The copying machine has a main controlling unit 500 configured by a computer, and the mail controller 500 controls driving of each part. The main controlling unit 500 has a CPU that executes various operations and driving control of each part, and a ROM (read only memory) 503 that stores solid data such as computer programs in advance and a RAM (random access memory) 504 that serves as a work area for storing various data in a rewritable manner connected to the CPU 501 via a bas line 502.

The ROM 503 stores a conversion table (not shown) on which information about conversion from output values of the toner density sensor 310 and correction sensor 330 to toner adhesion amount per unit area is stored.

To the main controlling unit 500, each part of the copying machine main unit 100, the paper feeder 200, the scanner 300 and the auto document feeder 400 are connected. The toner density sensor 310, the potential sensor 320 and the correction sensor 330 of the copying machine main unit 100 sends the detected information to the main controlling unit 500.

Next, operation of the copying machine according to the second embodiment will be explained. When a duplicate of a document is to be created by using the copying machine having the above configuration, first a document is placed on a document holder 30 of the auto document feeder 400. Alternatively, a document may be placed on the contact glass 31 of the scanner 300 by opening the auto document feeder 400, and the document may be held down by closing the auto document feeder 400. Thereafter, when the user presses a starting switch (not shown), the document is conveyed on the contact glass 31 when the document is placed on the auto document feeder 400. Then the scanner 300 is driven and the first running member 33 and the second running member 34 start running. As a result, the light from the first running member 33 is reflected by the document on the contact glass 31, and the reflection light is reflected by the mirror of the second running member 34 and introduced to the reading sensor 36 via the imaging lens 35. In this manner, image information of the document is read out.

When the user presses the starting switch, the driving motor (not shown) drives to rotate one of the supporting rollers 14, 15, and 16 to rotate the intermediate transfer belt 10. Simultaneously, the respective photoconductor drums 20Y, 20C, 20M, and 20K of the image forming units 18Y, 18C, 18M, and 18K are also rotated. Thereafter, based on the image information read out by the reading sensor 36 of the scanner 300, the light exposure device 21 irradiates the photoconductor drums 20Y, 20C, 20M, and 20K of the image forming units 18Y, 18C, 18M, and 18K with the writing beam. As a result, an electrostatic latent image is formed on each of the photoconductor drums 20Y, 20C, 20M, and 20K, and then visualized by each of the developers 61Y, 61C, 61M, and 61K. Thus, toner images of yellow, cyan, magenta and black are respectively formed on the photoconductor drums 20Y, 20C, 20M, and 20K.

The toner images of each color thus formed are sequentially and individually subjected to primary transferring by the respective primary transfer devices 62Y, 62C, 62M, and 62K so that they overlap with each other on the intermediate transfer belt 10. As a result, a combined toner image wherein toner images of each color overlap with each other is formed on the intermediate transfer belt 10. The toner remaining after transfer on the intermediate transfer belt 10 after secondary transferring is eliminated by the belt cleaner 17.

Also when a user presses the starting switch, the paper feeding roller 42 of the paper feeder 200 corresponding to the transfer paper 5 selected by the user rotates, and the transfer paper 5 is sent out of one of the paper feeding cassettes 44. The sent out transfer paper 5 is separated to a single sheet by the separating roller 45 and enters the paper feeding path 46 where it is conveyed to the conveying path 48 in the copying machine main unit 100 by means of the conveying roller 47. The transfer paper 5 thus conveyed comes into abutment with the registration roller 49*b* and stops. When the transfer paper 5 that is not placed in the paper feeding cassette 44 is used, the transfer paper 5 that is placed on the manual feeding tray 6 is sent by the paper feeding roller 50 and separated to a single sheet by the separating roller 52, and then conveyed along the manual paper feeding path 53. Then the transfer paper 5 comes into abutment with the registration roller 49*b* and stops.

The registration roller 49*b* start rotating in timing with that the combined toner image formed on the intermediate transfer belt 10 as described above is conveyed to the secondary transferring part opposing to the secondary transfer roller 24. The registration roller 49*b* is generally used while being earthed, however, it may be applied with a bias so as to remove paper powder of the transfer paper 5. The transfer paper 5 sent out by the registration roller 49*b* is then fed between the intermediate transfer belt 10 and the secondary transfer roller 24, and the combined toner image on the intermediate transfer belt 10 is secondarily transferred onto the transfer paper 5 by means of the secondary transfer roller 24. Thereafter, the transfer paper 5 is conveyed to the fixing device 25 while adsorbing to the secondary transfer roller 24, and then the toner image is subjected to fixing process by application of heat and pressure by the fixing device 25. The transfer paper 5 having passed through the fixing device 25 is then discharged to the paper discharge tray 7 by the discharging roller 56 in a stacking manner. In this connection, when an image is to be formed on the reverse side of the surface on which the toner image has been fixed, the conveying direction of the transfer paper 5 having passed through the fixing device 25 is switched by means of the switching claw 55 and the transfer paper is fed into the paper inversing device 93. The transfer paper 5 is inversed at this device and introduced again to the secondary transfer roller 24.

Figure 18:
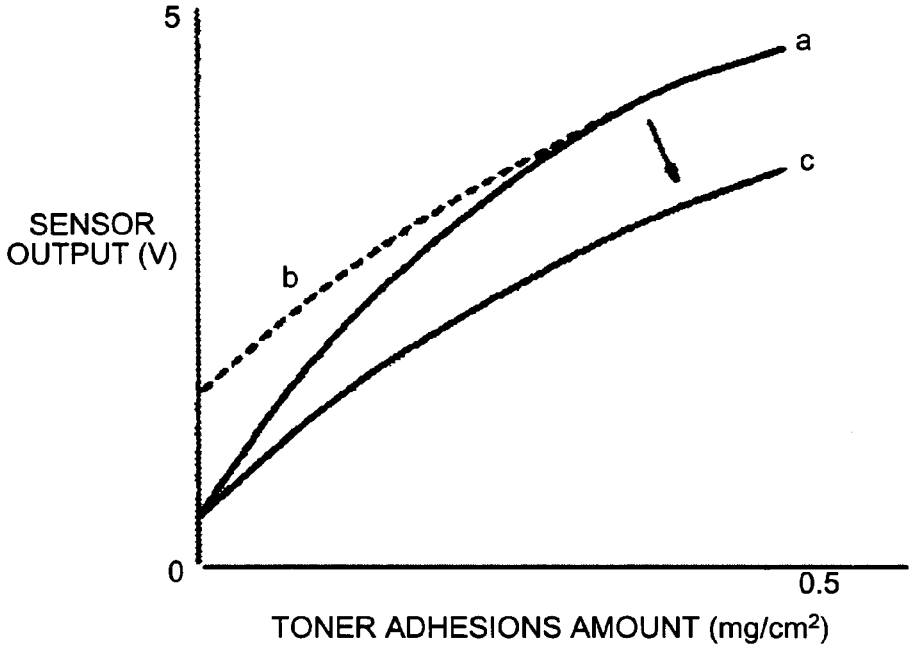
FIG. 18 is a graph representing relationship between toner adhesion amount on the photoconductor drum and sensor output.
Figure 19:
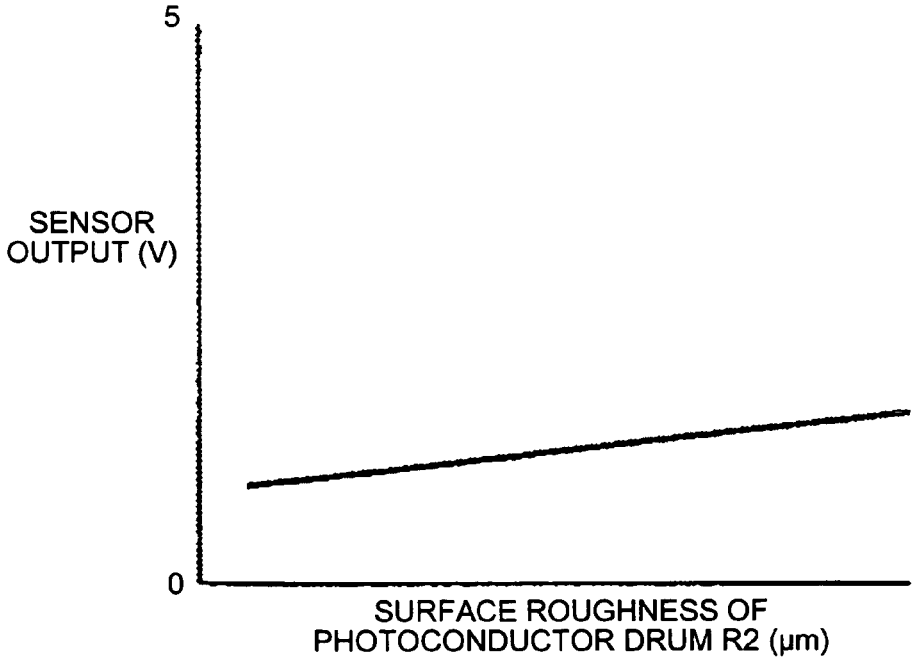
FIG. 19 is a graph representing relationship between surface roughness of the photoconductor drum and sensor output.
Figure 21:
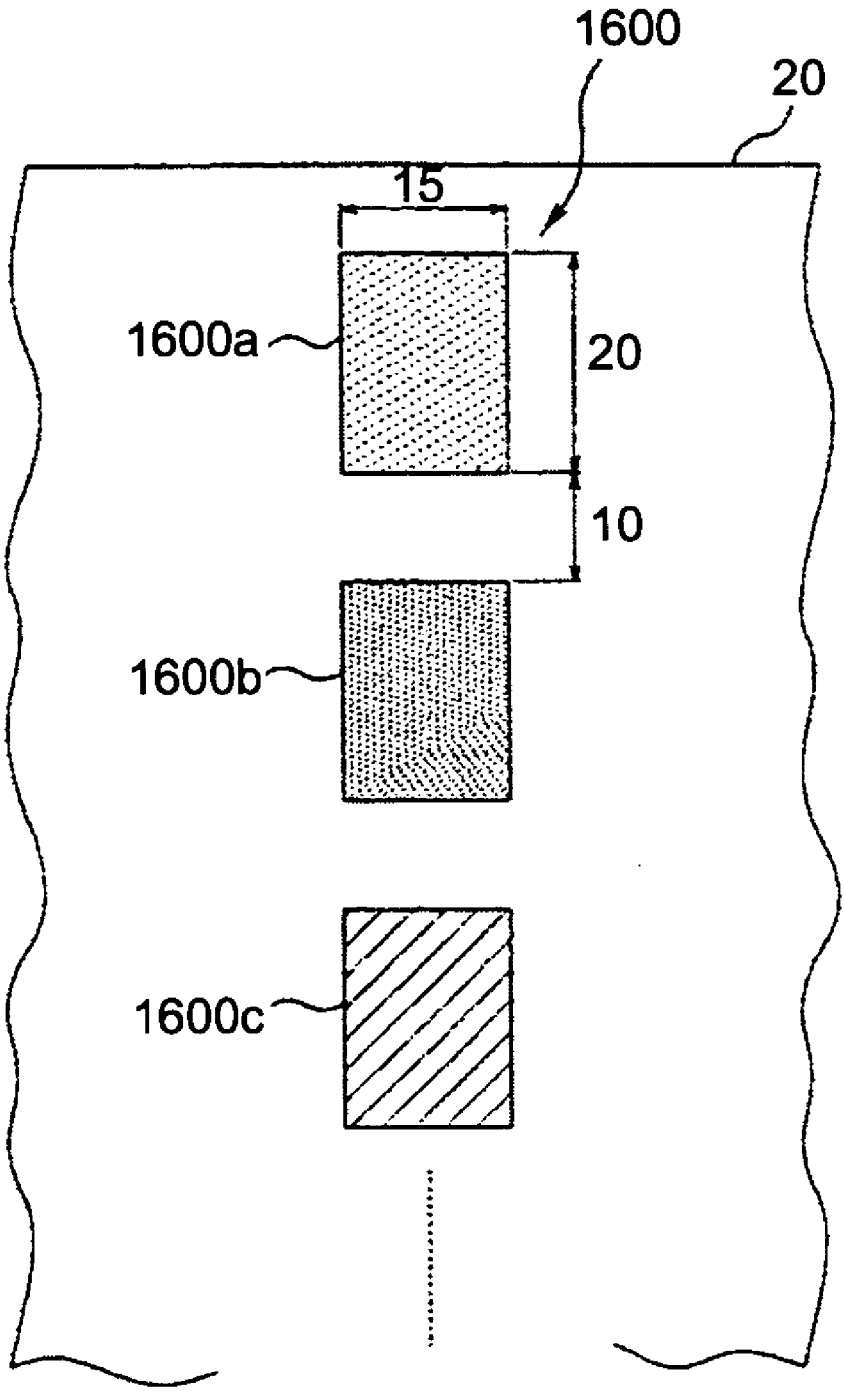
FIG. 21 is an explanatory view of patch patterns to be formed on the photoconductor drum.
Figure 22:
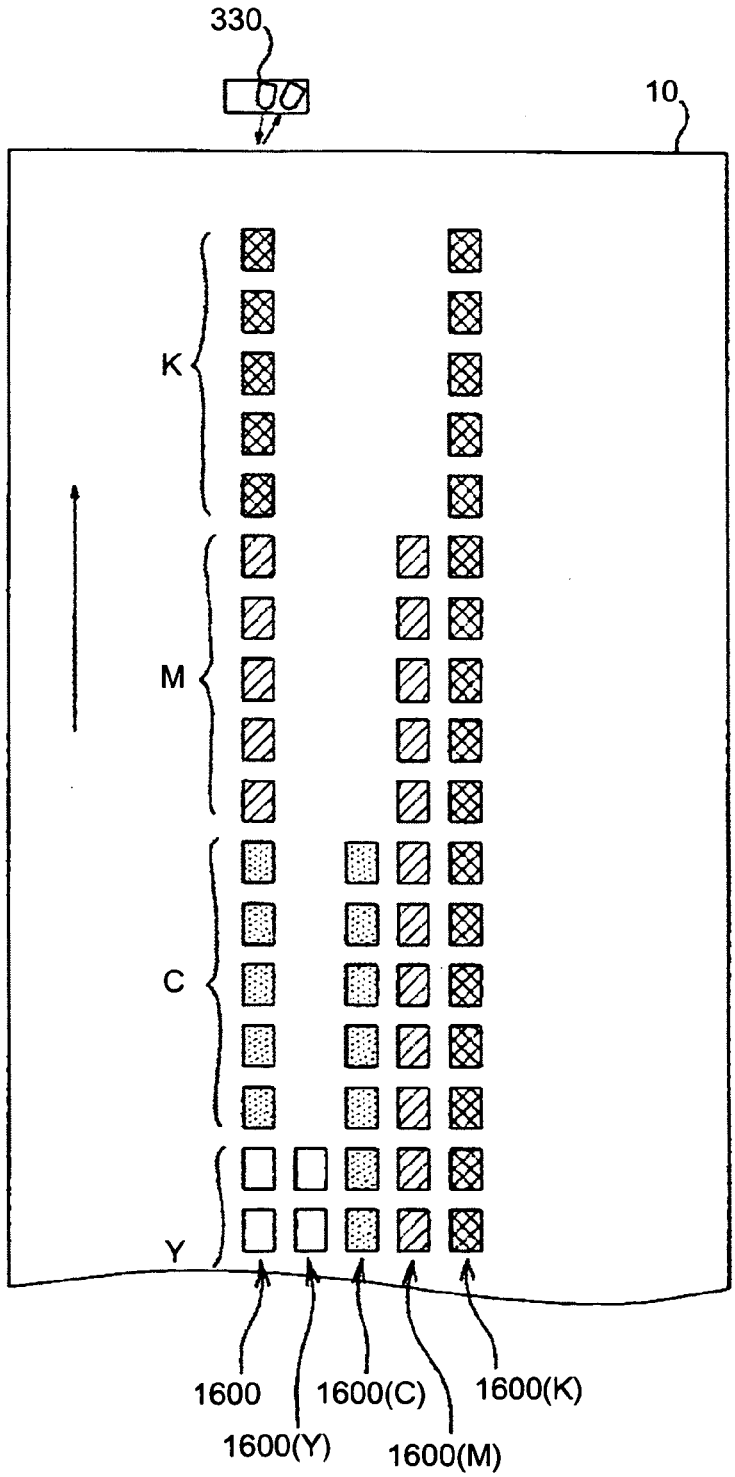
FIG. 22 is an explanatory view of patch patterns to be transferred onto the intermediate transfer belt.
Figure 23:
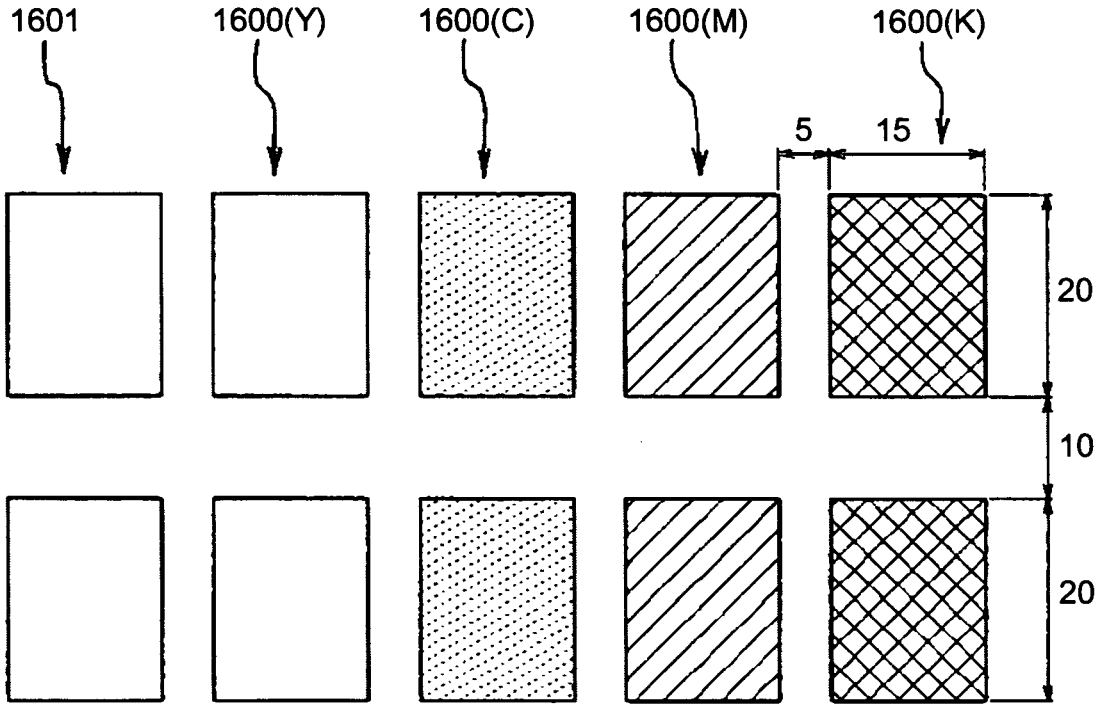
FIG. 23 is an enlarged view of the same patch patterns.
Figure 24:
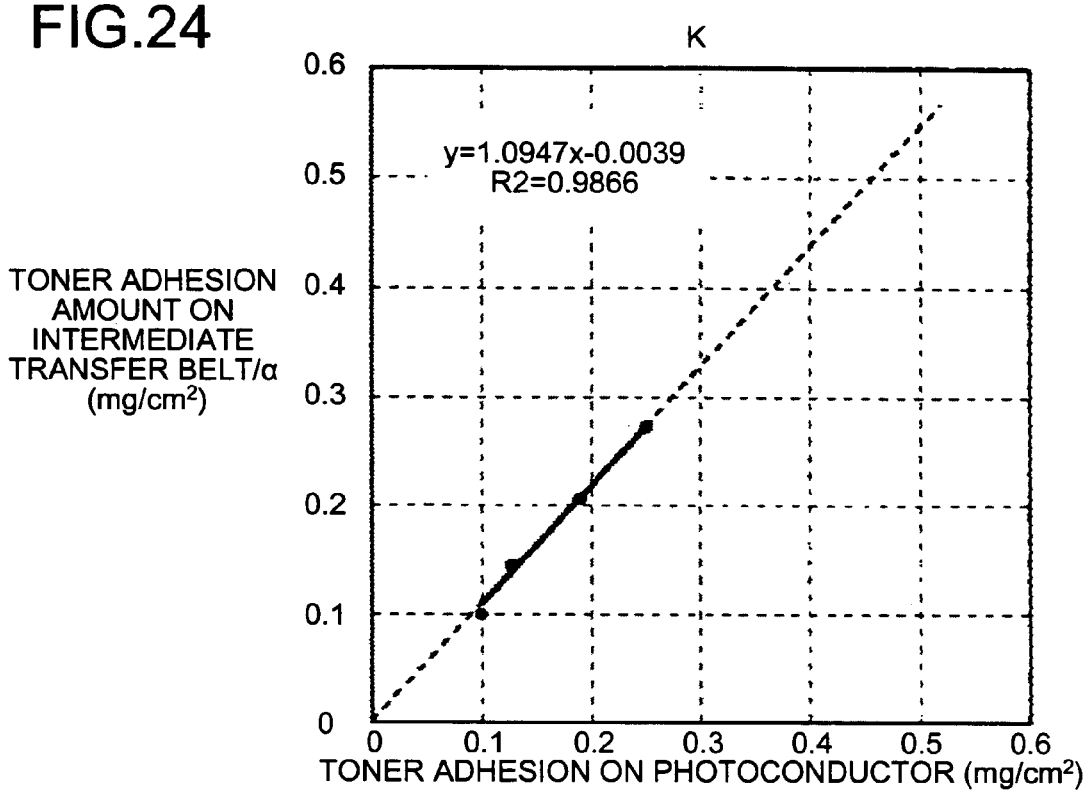
FIG. 24 is a graph representing relationship between toner adhesion amount on the photoconductor drum regarding black and toner adhesion amount on the intermediate transfer belt.
Figure 25:
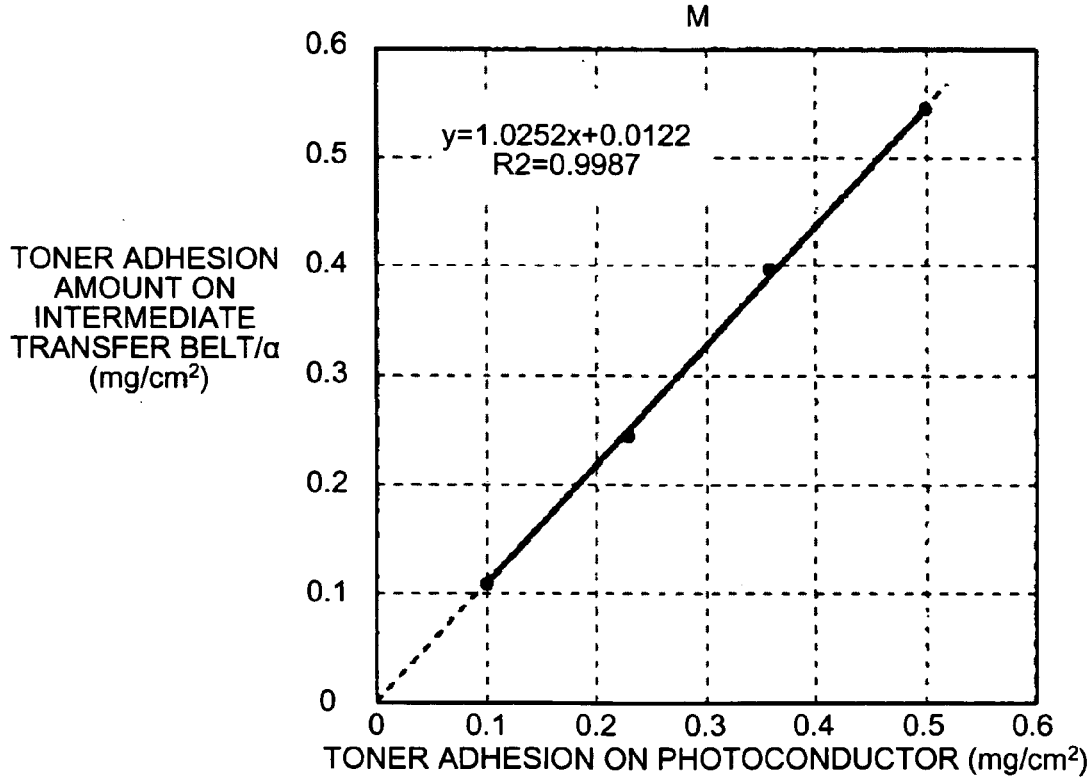
FIG. 25 is a graph representing relationship between toner adhesion amount on the photoconductor drum regarding magenta and toner adhesion amount on the intermediate transfer belt.
Figure 26:
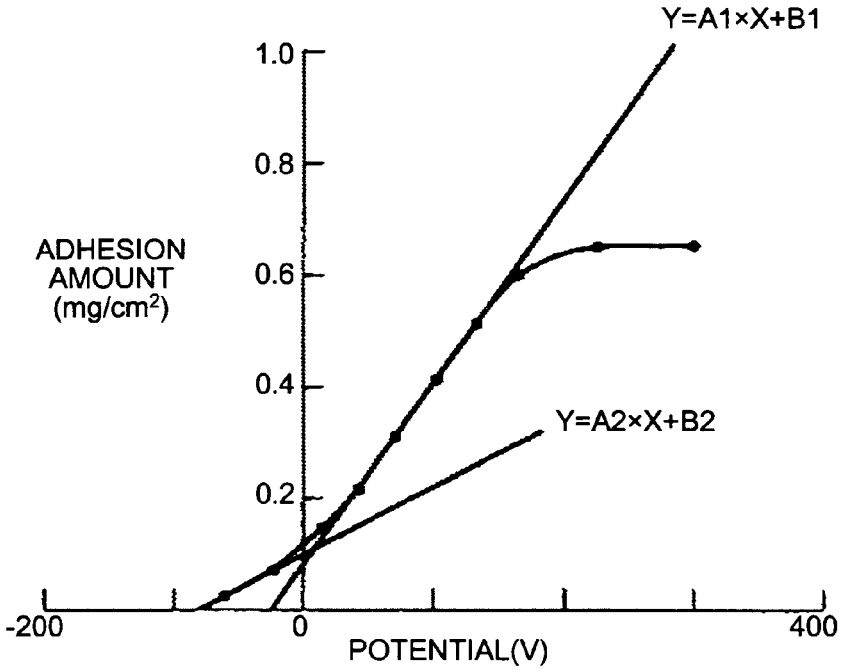
FIG. 26 is a graph representing relationship between potential data and toner adhesion amount data in each patch pattern under potential control.
Figure 27:
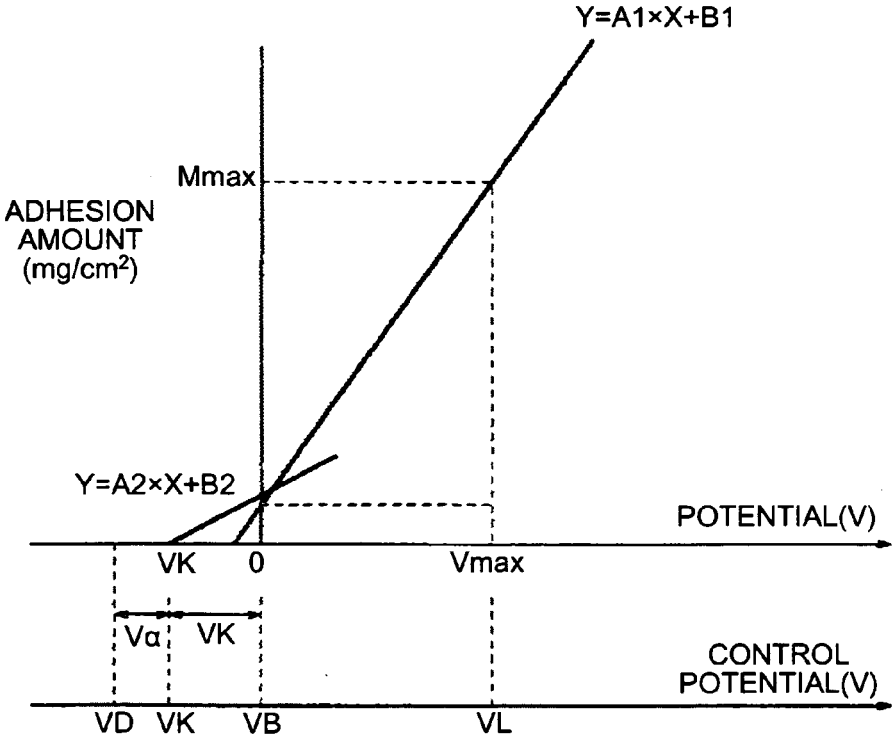
FIG. 27 is a graph of collinear approximation of potential data and control potential data with regard to toner adhesion amount data under potential control.

Next, with reference to FIGS. 18 to 28, explanation will be made about an image density control conducted by the CPU 501 of the second embodiment according to a computer program, which is a self-check potential control processing. FIG. 18 is a graph representing relationship between toner adhesion amount on the photoconductor drum 20 and sensor output, FIG. 19 is a graph representing relationship between surface roughness of the photoconductor drum 20 and sensor output, FIG. 20 is a flowchart of the potential control routine, FIG. 21 is an explanatory view for patch patterns formed on the photoconductor drum 20, FIG. 22 is a plan view of the patch patterns transferred onto the intermediate transfer belt 10, FIG. 23 is an enlarged view of the patch patterns, FIG. 26 is a graph of relationship in each patch pattern between the potential data and toner adhesion data under potential control, FIG. 27 is a graph of collinear approximation of potential data and control potential data with regard to toner adhesion amount data under potential control, and FIG. 28 is a schematic view of a potential control table.

The potential control process is a process conducting potential control based on the detection result of the toner density sensor 310. However, the output characteristic of the toner density sensor 310 may change due to a variety of factors. For addressing this problem, in the potential control process of the second embodiment, the detection results of the toner density sensors 310 are corrected based on the detection result of the correction sensor 330, and the process is executed by using the corrected detection results.

Now changes in output characteristics of the toner density sensor 310 will be explained while taking an example. When the photoconductor drum 20 is new, the sensor characteristic shows the line "a" in FIG. 18. However, as the surface of the photoconductor drum 20 is getting rough because of aged deterioration, diffusing components increases in the light reflection of the surface of the photoconductor drum 20 as shown in FIG. 19, which results in higher sensor outputs of the toner density sensor 310. As a result, the sensor output characteristic becomes the characteristic denoted by the line "b" in FIG. 18. In the copying machine according to the second embodiment, since Vsg adjustment is regularly conducted so that the output of the toner density sensor 310 with respect to the photoconductor drum 20 is constant as will be described below, the characteristic of the line "b" is adjusted so that the face output is similar to the line "a". At this time, adjustment that lowers the LED emission amount of the toner density sensor 310 is conducted so as to lower the output of the toner density sensor 310. Accordingly, the sensor output characteristic of the toner density sensor 310 becomes the characteristic denoted by the line "c" in FIG. 18. As a result, the characteristic changes from the line "a" to the line "b" for the same sensor output, so that the toner adhesion amount to be calculated also changes. If such a change occurs for all colors at the same time, the color balance does not significantly change, however, in such a configuration as is the copying machine of the second embodiment that different photoconductor drums 20 are provided for each color, the manner of surface deterioration also differs among these photoconductor drums 20. Even if the manners of surface deterioration of the photoconductor drums 20 are even, the toner adhesion amount to be calculated will change due to the error of voltage after Vsg adjustment for each color.

The potential control routine shown in FIG. 20 is basically executed at the startup of the copying machine, whenever a certain number of copies are made (between imaging operations during continuous imaging operation), and whenever a certain time is elapsed. In this description, operation at the time of startup will be explained. First, in order to distinguish the condition when the power is turned ON from the condition when abnormality such as jamming is to be processed, the fixing temperature of the fixing device 25 is detected as an execution condition of the potential control in step S201. Based on an input signal from the fixing temperature sensor, whether the fixing temperature of the fixing device 25 is more than 100° C. is determined. When the fixing temperature of the fixing device 25 is more than 100° C. ("No" in step S201), it is determined that abnormality occurs and the processing ends without executing the potential control.

When the fixing temperature of the fixing device 25 is not more than 100° C. ("Yes" in step S201), the surface potential of each photoconductor drum 20 uniformly charged at a predetermined condition is checked by the potential sensor 320 (step S202), and then Vsg adjustment is conducted in step S203 (step S203). In this Vsg adjustment, light emission amount of the toner density sensor 310 is adjusted so that the irradiation light to the face of the photoconductor drum 20 from the toner density sensor 310 is reflected at a constant value by capturing an output value with respect to the face (surface) of the photoconductor drum 20 from the toner density sensor 310. In steps S202 to S203, the processing is conducted in parallel in the image forming units 18 for respective colors.

In step S204, whether abnormality occurs in the processes of step S202 to S203 is checked. When abnormality is found ("No" in step S204), the flow proceeds to step S218 where an error code is set and the processing ends.

In step S204, when it is determined that there is no abnormality in the processes of steps S202 to S203 ("Yes" in step S204), whether the selected method for the potential control is "automatic" or "fixed" is determined (step S205).

In steps S203 to S204, the operation is conducted prior to step S206 for use in other toner supply control and the like regardless of the potential control method.

When it is determined in step S205 that the potential control method is not an automatic but a fixed method ("No" in step S205), an error code is set in step S218 and the processing ends. On the other hand, when it is determined in step S205 that the potential control method is automatic method ("Yes" in step S205), the processes of step S206 to S207 are executed in parallel for the image forming units 18 of the respective colors.

In step S206, as shown in FIG. 16, patch patterns (latent image patterns) 1600 serving as a reference toner patch which are toner images are formed on each photoconductor drum 20. The patch patterns 1600 are formed while shifted by colors in the direction of axial centers 90 (width direction) of the photoconductor drums 20. In the second embodiment, N patch patterns 1600 (1600*a*, 1600*b*, 1600*c*, . . . ) which are electrostatic latent images having N gradation densities as shown in FIG. 21 for each color are formed on at a certain interval along the rotation direction of the photoconductor drum 20. In the second embodiment, rectangular patch patterns 1600 (1600*a*, 1600*b*, 1600*c*, . . . ) of 15×20 mm having different 16 gradation densities are formed at an interval of 10 mm along the rotation direction of the photoconductor drum 20. The distance between these patch patterns 1600 for each color in the direction of axial centers 90 of the photoconductor drums 20 is 5 mm (see FIG. 23). In this manner, the patch patterns 1600 are formed so as to be adjacent with each other, making the entire width thereof fall within A6 width.

In addition to these patch patterns 1600, patch patterns 1601 which is a reference toner patch for correction are imaged on the photoconductor drum 20 for each color as shown in FIG. 16. These patch patterns 1601 are formed while shifted from the patch patterns 1600 in the direction of axial centers 90 of the photoconductor drums 20. More specifically, the patch patterns 1601 are formed outside the area occupied by the patch patterns 1600Y, 1600C, 1600M, and 1600K in the direction of axial centers 90 of the photoconductor drums 20 when they are transferred to the intermediate transfer belt 10. At this time, the photoconductor drums 20 of the patch pattern 1600 and the patch patterns 1601 are arranged in the direction of axial centers in the following sequence: the patch pattern 1601, patch pattern 1600Y, patch pattern 1600C, patch pattern 1600M and patch pattern 1600K. The size and their interval of the patch patterns 1601 are similar to those of the patch patterns 1600, and an imaging condition of the patch pattern 1601 is also as same as that of the patch patterns 1600. The function of the toner patch forming unit is executed in step S206.

By forming the patch patterns 1600, 1601 as described above, it is possible to form the patch patterns 1600, 1601 for each color on the intermediate transfer belt 10 while preventing them from overlapping with each other, as shown in FIG. 22 when the patch patterns 1600, 1601 are transferred onto the intermediate transfer belt 10. FIG. 23 is an enlarged view of the patch patterns 1600, 1601 on the intermediate transfer belt 10.

In next step S207, output values from the potential sensor 320 for the potentials of the patch patterns 1600 on the photoconductor drum 20 are read and stored in the RAM 504. Then the black developer 61K, cyan developer 61C, magenta developer 61M, and yellow developer 61Y are made to develop the patch patterns 1600, 1601 for four colors on the photoconductor drum 20 and visualize the same, thereby obtaining toner images for each color.

Then, the CPU 501 executes detection of toner density for the patch patterns 1600 of the photoconductor drum 20 by means of the toner density sensor 310 and detection of density for the patch pattern 1601 transferred to the intermediate transfer belt 10 by means of the correction sensor (step S208). In this detection of toner density, output values of the toner density sensor 310 and the correction sensor 330 for the patch patterns 1600, 1601 which are toner images for each color are stored in the RAM 504 as Vpi (i=1 to N) for each color.

Next, adhesion amount of toner is calculated (step S209). That is, output values of the toner density sensor 310 and correction sensor 330 stored in the RAM 504 are converted to toner adhesion amounts per unit area while looking up the conversion table stored in the ROM 503 and the conversion results are stored again in the RAM 504.

Next, the adhesion amount of toner on the photoconductive drum 20 based on the detection value of the toner density sensor 310 calculated in step S209 is corrected based on the detection value of the correction sensor 330 (step S210, correcting unit). The relationship between toner adhesion amount on the photoconductor drum 20 previously calculated (hereinafter, also referred to as toner adhesion amount on drum) and toner adhesion amount on the intermediate transfer belt 10 (hereinafter, also referred to as toner adhesion amount on belt) can be represented by the following equations, when a coefficient corresponding to a deviation from the true value of toner adhesion amount for each of the four toner density sensors 310Y, 310C, 310M, and 310K is denoted by "A", and toner transfer rate (%) from the photoconductor drum 20 to the intermediate transfer belt 10 is denoted by "α":

$$\text{toner adhesion amount on drum } (K) = \text{toner adhesion amount on belt } (K)/\alpha \quad (21)$$

$$\text{toner adhesion amount on drum } (M) = \text{toner adhesion amount on belt } (M)/\alpha \quad (22)$$

$$\text{toner adhesion amount on drum } (C) = \text{toner adhesion amount on belt } (C)/\alpha \quad (23)$$

$$\text{toner adhesion amount on drum } (Y) = \text{toner adhesion amount on belt } (Y)/\alpha \quad (24)$$

However, since the actual detection results involve the respective detection errors, the following equations are established. In these equations, a coefficient corresponding to a deviation from the true value of each toner adhesion amount for the correction sensor 330 is denoted by "B".

$$\text{toner adhesion amount on drum } (K) \times A(K) = \text{toner adhesion amount on belt } (K) \times B(K)/\alpha \quad (25)$$

$$\text{toner adhesion amount on drum } (M) \times A(M) = \text{toner adhesion amount on belt } (M) \times B(M)/\alpha \quad (26)$$

$$\text{toner adhesion amount on drum } (C) \times A(C) = \text{toner adhesion amount on belt } (C) \times B(C)/\alpha \quad (27)$$

$$\text{toner adhesion amount on drum } (Y) \times A(Y) = \text{toner adhesion amount on belt } (Y) \times B(Y)/\alpha \quad (28)$$

As for "B", since there is only one correction sensor 330, it would not differ among colors. The transfer rate α is about 95% in the second embodiment. Assuming B=1, the following equations are established:

$$\text{toner adhesion amount on drum } (K) \times A(K) = \text{toner adhesion amount on belt } (K)/\alpha \quad (29)$$

$$\text{toner adhesion amount on drum } (M) \times A(M) = \text{toner adhesion amount on belt } (M)/\alpha \quad (30)$$

$$\text{toner adhesion amount on drum } (C) \times A(C) = \text{toner adhesion amount on belt } (C)/\alpha \quad (31)$$

$$\text{toner adhesion amount on drum } (Y) \times A(Y) = \text{toner adhesion amount on belt } (Y)/\alpha \quad (32)$$

Next, based on these equations, a post correction toner adhesion amount in which the toner adhesion amount on the photoconductor drum 20 has been corrected is determined from the toner adhesion amount on the photoconductor drum 20 and the toner adhesion amount on the intermediate transfer belt 10 having detected so far by. First, explanation will be made while taking black (K) as an example.

In black (K), since outputs of the toner density sensor 310K and the correction sensor 330 are saturated in a region where toner adhesion amount is large, imaging is conducted while setting the imaging conditions for the patch patterns 1600, 1601 to capture data in a region where toner adhesion amount is small. Detection results of the toner density sensor 310K and the correction sensor 330 at this time are shown in Table 1. FIG. 13 is a graph of these results.

TABLE 1

| CORRECTION SENSOR | TONER DENSITY |
|---|---|
| 0.102 | 0.1 |
| 0.13 | 0.15 |
| 0.19 | 0.2 |
| 0.25 | 0.27 |
| | (mg/cm$^2$) |

Herein, A(K)=1.0497 is obtained.

Next, detection results of the toner density sensor 310M and the correction sensor 330 with regard to magenta (M) are shown in Table 2. FIG. 25 is a graph of these results.

TABLE 2

| CORRECTION SENSOR | TONER DENSITY |
|---|---|
| 0.102 | 0.12 |
| 0.23 | 0.24 |
| 0.367 | 0.395 |
| 0.5 | 0.523 |
| | (mg/cm$^2$) |

Herein A(M)=1.025 is obtained. In the similar manner, A(C)=1.057 and A(Y)=1.002 were obtained.

In the second embodiment, the toner adhesion amount on the photoconductor drum 20 is calculated based on the following equations obtained by transforming the above equations (29) to (32).

$$\text{toner adhesion amount on drum } (K) = \text{toner adhesion amount on belt } (K)/\alpha/A(K) \quad (33)$$

$$\text{toner adhesion amount on drum } (M) = \text{toner adhesion amount on belt } (M)/\alpha/A(M) \quad (34)$$

$$\text{toner adhesion amount on drum } (C) = \text{toner adhesion amount on belt } (C)/\alpha/A(C) \quad (35)$$

$$\text{toner adhesion amount on drum } (Y) = \text{toner adhesion amount on belt } (Y)/\alpha/A(Y) \quad (36)$$

Assuming the toner adhesion amount on belt as a real value, the post correction toner adhesion amount on drum can be determined by the following equations.

$$\text{post correction toner adhesion amount on drum } (K) = \text{toner adhesion amount on drum } (K) \times \alpha \times A(K) \quad (37)$$

$$\text{post correction toner adhesion amount on drum } (M) = \text{toner adhesion amount on drum } (M) \times \alpha \times A(M) \quad (38)$$

$$\text{post correction toner adhesion amount on drum } (C) = \text{toner adhesion amount on drum } (C) \times \alpha \times A(C) \quad (39)$$

$$\text{post correction toner adhesion amount on drum } (Y) = \text{toner adhesion amount on drum } (Y) \times \alpha \times A(Y) \quad (40)$$

For example, when detection result of the toner adhesion amount with regard to (M) on the photoconductor drum 20 is 0.506, the toner adhesion amount on the photoconductor drum 20 after correction can be determined by 0.506×1.025×0.95=0.493 (mg/cm2) according to the equation (38).

Now, another form of correction will be explained. In the present form, (M) toner is selected as a reference for adhesion amount of color in consideration of the case where detection accuracy of detection of color toner adhesion amount on the intermediate transfer belt 10 is poor. This keeps the detection balance of adhesion amount of color. Concretely, assuming A(M)=1, $$A(C)' = A(C)/A(M) = 1.057/1.025 = 1.031 \text{ and}$$

$$A(Y)' = A(Y)/A(M) = 1.002/1.025 = 0.978$$

can be obtained. In this form, correction for (K) which little affects on color balance is not conducted.

When the toner adhesion amount on the intermediate transfer belt 10 for (M) is regarded as a reference, the toner adhesion amount on the photoconductor drum 20 after correction can be determined by the following equations.

$$\text{post correction toner adhesion amount on drum } (M) = \text{toner adhesion amount on drum } (M) \times \alpha \times A(M)/A(M) \quad (41)$$

$$\text{post correction toner adhesion amount on drum } (C) = \text{toner adhesion amount on drum } (C) \times \alpha \times A(C)/A(M) \quad (42)$$

$$\text{post correction toner adhesion amount on drum } (Y) = \text{toner adhesion amount on drum } (Y) \times \alpha \times A(Y)/A(M) \quad (43)$$

For example, when the detection result of the toner adhesion amount of (C) on the photoconductive drum 20 is 0.456, the toner adhesion amount on the photoconductor drum 20 after correction can be determined by 0.456×1.031×0.95=0.447 (mg/cm2) according to the equation (42).

After calculating the toner adhesion amount of each color while making correction by the above two forms of correction method, steps S211 to S213 are executed. These steps will be explained in detail below.

FIG. 26 represents relationship between potential data obtained of patch patterns 1600 on the photoconductor drums 20 obtained in the process so far by and toner adhesion data in each of the patch patterns 1600 (1600*a*, 1600*b*, 1600*c*, . . . ) plotted on the X-Y plane. The X axis represents potential (difference between developing bias potential VB and surface potential of the photoconductor drum 20) (unit: volt), and the Y axis represents toner adhesion amount per unit area (mg/cm$^2$). In the second embodiment, the toner density sensor 310 is configured by an infrared light reflective type sensor based on the optical system as described above. Since an infrared light reflective type sensor generally shows saturation characteristic at a dense adhesion part where a large amount of toner adheres, as shown in FIG. 26, the obtained detection values no longer reflect the actual toner adhesion amounts in such a dense adhesion part. Therefore, when a toner adhesion amount is calculated by directly using a detection value from the toner density sensor 310 obtained in a dense adhesion part, an adhesion amount that is different from the actual adhesion amount is obtained, which disables accurate execution of the toner supply control based on the toner adhesion amount.

For addressing this problem, in the CPU 501 according to the second embodiment, for the patch patterns 1600 (1600*a*, 1600*b*, 1600*c*, . . . ) of each color, potentials of the patch patterns 1600 (1600*a*, 1600*b*, 1600*c*, . . . ) obtained from the potential sensor 320 and the toner density sensor 310, and data of toner adhesion amount after visualization are picked out only in the interval where the relationship between potential data Xn (n=1 to 10) and toner adhesion data Yn (development γ characteristic) is linear as described below, and the data falling within this interval is subjected to least square method, to thereby conduct collinear approximation of the development characteristic of each developer 61 in the manner as will be described below. An approximate linear equation of development characteristic is obtained for each color, and a control potential is calculated for each color using this approximate linear equation.

Calculation of least square method uses the following equations:

$$Xave = \Sigma Xn/k \quad (51)$$

$$Yave = \Sigma Yn/k \quad (52)$$

$$Sx = \Sigma(Xn - Xave) \times (Xn - Xave) \quad (53)$$

$$Sy = \Sigma(Yn - Yave) \times (Yn - Yave) \quad (54)$$

$$Sxy = \Sigma(Xn - Xave) \times (Yn - Yave) \quad (55)$$

When the approximate linear equation established from the potentials of the patch patterns 1600 (1600*a*, 1600*b*, 1600*c*, . . . ) obtained by the potential sensor 320 and the toner density sensor 310, and the data of toner adhesion amount after visualization is represented by Y=A1×X+B1, coefficients A1 and B1 can be expressed by the following equations using the above variables:

$$A1 = Sxy/Sx \quad (56)$$

$$B1 = Yave - A1 \times Xave \quad (57)$$

And correlation coefficient R of the approximate linear equation can be expressed by:

$$R \times R = (Sxy \times Sxy)/(Sx \times Sy) \quad (58)$$

In the second embodiment, the CPU 501 picks out five sets of data in ascending order of Yn value, each set consisting of potential data Xn of the patch patterns 1600 (1600*a*, 1600*b*, 1600*c*, . . . ) obtained from the potential sensor 320 and the toner density sensor 310 for each color until step S209, and data of toner adhesion amount after visualization Yn:

(X1 to X5, Y1 to Y5)
(X2 to X6, Y2 to Y6)
(X3 to X7, Y3 to Y7)
(X4 to X8, Y4 to Y8)
(X5 to X9, Y5 to Y9)
(X6 to X10, Y6 to Y10)

Then the CPU 501 makes collinear approximation in accordance with the above equations (51) to (58) and calculates the correlation coefficient R, to obtain six sets of approximate linear equation and correlation coefficients (59) to (64) as follows:

$$Y11 = A11 \times X + B11; R11 \quad (59)$$

$$Y12 = A12 \times X + B12; R12 \quad (60)$$

$$Y13 = A13 \times X + B13; R13 \quad (61)$$

$$Y14=A14\times X+B14;R14 \quad (62)$$

$$Y15=A15\times X+B15;R15 \quad (63)$$

$$Y16=A16\times X+B16;R16 \quad (64)$$

The CPU 501 selects as the approximate linear equation one set of approximate linear equation corresponding to the maximum value of the correlation coefficients R11 to R16 from the obtained six sets of approximate linear equations.

Next, the main controlling unit 500 (CPU 501) calculates a value of X where the value of Y is the necessary maximum toner adhesion amount Mmax as shown in FIG. 27, or a value of development potential Vmax in the selected approximate linear equation for each color in step S211. The bias potential VB of each of the black developer 61K, cyan developer 61C, magenta developer 61M and yellow developer 61Y and the surface potential (exposure potential) VL given by light exposure of each color image on the photoconductor drum 20 can be represented by the following equations (65) and (66) from the above equations:

$$V\max=(M\max-B1)/A1 \quad (65)$$

$$VB-VL=V\max=(M\max-B1)/A1 \quad (66)$$

The relationship between the VB and VL can be represented by using the coefficient of the approximate linear equation (E). Therefore, the equation (66) is $$M\max=A1\times V\max+B1 \quad (67).$$

The relationship between charge potential VD before light exposure of the photoconductor drum 20 and development bias potential VB can be obtained from an X coordinate of intersect VK (development starting voltage of the developer 61) between the linear equation shown in FIG. 27, $$Y=A2\times X+B2 \quad (68)$$

and the X axis, and a background margin voltage Vα that is experimentally determined, by the equation as follows:

$$VD-VB=VK+V\alpha \quad (69)$$

Therefore, the relationship between Vmax, VD, VB, and VL is determined by the equations (66) and (69). In this example, relationships between Vmax which is a reference and each control voltage VD, VB, and VL are determined in advance by experiments and the like, and the determined relationships are stored in the ROM 503 by a potential control table T1 as shown in FIG. 28.

Then, the CPU 501 selects a Vmax which is nearest to the Vmax calculated for each color from the potential control table T1 in step S212, and sets each control voltage VB, VD, and VL corresponding to the selected Vmax as a target potential.

Next, in step S212, the semiconductor laser is controlled so that the laser emission power is maximum light intensity via the laser controller of the light exposure device 21, and output values of the potential sensor 320 are captured, whereby the remaining potential of the photoconductor drum 20 is detected (step S213). Then in step S214, when the remaining potential is not 0, the target potentials VB, VD, and VL determined in step S212 are corrected by that remaining potential, to render them new target potentials.

In step S215, whether there is an error in steps S205 to S214 is determined. When there is an error in only one color ("No" in step S215), even if controls are executed for other colors, the image density will significantly change and the operation subsequently executed in S216 will have no utility. Therefore, an error code is set (step S218) and the processing ends. In this case, the imaging condition is not renewed, and imaging is executed in the same condition as previously used until the self-check of the next time succeeds.

In step S215, when it is determined that there is no error ("Yes" in step S215), the power circuit (not shown) is adjusted so that the charge potential VD by the charger 60 of the photoconductor drum 20 becomes the above target potential in parallel manner for each color in step S216, and the light emission power in the semiconductor laser is adjusted via the laser controller (not shown) so that the surface potential VL of the photoconductor drum 20 becomes the above target potential, and the power circuit is adjusted so that the development bias potentials VB of the black developer 61K, cyan developer 61C, magenta developer 61M and yellow developer 61Y become respective target potentials (image density controlling unit).

Then in step S217, whether there is an error in step S216 is determined. When there is no error in step S216 ("Yes" in step S217), the processing ends. On the other hand, when there is an error in step S216 ("No" in step S217), the flow proceeds to step S218 where an error code is set, and the processing ends.

The potential control as described above is important control especially in a color image forming apparatus for keeping the image quality constant.

As described above, in the second embodiment, even if the detection characteristics of the toner density sensors 310Y, 310C, 310M and 310K provided for the photoconductor drums 20 differ from each other, the detection results are corrected by using the detection result of the correction sensor 330 that detects toner density of the intermediate transfer belt 10, so that it is possible to prevent occurrence of deficiency in image density caused by differences in detection characteristics of the toner density sensors 310Y, 310C, 310M and 310K and it is possible to provide a copying machine ensuring stable image density. Accordingly, it is possible to provide a copying machine capable of ensuring stable image density for a long time even if the environment changes.

Furthermore, in the second embodiment, the patch patterns 1600 corresponding to the respective photoconductor drums 20 for executing potential control which is the image density control are transferred while shifted from each other on the intermediate transfer belt 10, as shown in FIG. 22, and hence the loads on the belt cleaner 17 and roller cleaning part 91 are reduced, so that it is possible to prevent occurrence of toner scattering due to insufficient cleaning by such cleaners and transfer spattering in the transfer process. Furthermore, since the patch patterns 1600 of each color can be formed on the respective photoconductor drums 20 in parallel, it is possible to reduce the user's waiting time required for executing the potential control.

Additionally, in the second embodiment, since the patch patterns 1600 and the patch pattern 1601 can be imaged in parallel, it is possible to reduce the user's waiting time required for executing the image density control such as potential control involving formation of the patch patterns 1600.

Furthermore, in the second embodiment, since the toner density is corrected based on the patch patterns 1600 and 1601 imaged in the same condition, it is possible to improve the correction accuracy.

Furthermore, in the second embodiment, since the toner density sensor 310K corresponding to black (K) is located at a farther position from the correction sensor 330 than the other toner density sensors 310Y, 310C and 310M, or in other words, since the positional relationships between the correction sensor 330 and the toner density sensors 310Y, 310C and 310M corresponding to toner of other colors (Y, M and C) that are much contribute on color variation compared to toner of black (K) are closer than the positional relationship between the correction sensor 330 and the toner density sensor 310K corresponding to black (K), it is possible to reduce a difference depending on the imaging positions of the patch patterns 1600, 1601 and improve the correction accuracy.

Furthermore, in the second embodiment, the entire patch patterns 1600 are designed to fall within the A6 width, although usual output images have a width of A6 width or more. As a consequence, variation at the patch patterns 1600 for each color decreases and detection error for each color depending on the detection position decreases, so that it is possible to provide a copying machine realizing high speed and high accuracy.

In the second embodiment, in order to process the outputs of the potential sensor 320 and the toner density sensor 310 in parallel for four colors in the potential control process which is an image density control, A/D having a sampling cycle of 4 msec is independently used for each channel.

The second embodiment is described while taking a copying machine as an example for the image forming apparatus, however, the image forming apparatus may be a printer or the like without limited to the copying machine.

According to the present invention, even if detection characteristics of first detectors provided for a plurality of image bearing members photoconductor drums differ from each other, the detection results are corrected by using a detection result of a second detector that detects toner density on an intermediate transfer belt, so that it is possible to provide an image forming apparatus capable of preventing occurrence of deficiency in image density caused by differences in detection characteristics of the detectors and ensuring stable image density. Accordingly, it is possible to provide an image forming apparatus capable of ensuring stable image density for a long time even if the environment changes.

Furthermore, according to the present invention, since reference toner patches corresponding to at least two image bearing members are formed while shifted from each other and these reference toner patches are transferred on an intermediate transfer belt while shifted from each other, it is possible to prevent occurrence of toner scattering due to insufficient cleaning in the intermediate transfer cleaning and secondary transfer cleaning, as well as transfer spattering in the transfer process. Furthermore, since the reference toner patches can be formed in at least tow imaging units in parallel, it is possible to reduce the user's waiting time required for executing a self-check such as potential control.

According to the present invention, since the reference toner patch detected by the first detector and the reference toner patch detected by the second detector can be imaged in parallel, it is possible to reduce the user's waiting time required for executing the image density control such as potential control involving formation of the reference toner patch.

Furthermore, according to the present invention, since the correction is made based on the reference toner patches imaged in the same condition, it is possible to improve the correction accuracy.

Furthermore, according to the present invention, since the positional relationships between the second detector and the first detectors corresponding to toner of other colors that are much contribute on color variation compared to toner of black are closer than the positional relationship between the second detector and the first detector corresponding to black, it is possible to reduce a difference depending on the imaging positions of the reference toner patches and improve the correction accuracy.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a plurality of image bearing members, wherein each image bearing member is rotatable around an axis of rotation and bears a latent image;

a charging unit that electrically charge the image bearing member;

a light illuminating unit corresponding to each image bearing member, wherein the light illuminating unit illuminates light on a corresponding one of the image bearing members so as to form a latent image on the image bearing member;

a developing unit corresponding to each image bearing member, wherein the developing unit develops the latent image on a corresponding one of the image bearing members to form a toner image;

an intermediate transfer belt onto which the toner images on the image bearing members are transferred and from where the toner images are transferred onto a recording medium;

a driving unit that drives and rotates the intermediate transfer belt;

a supplying unit that supplies the recording medium to the intermediate transfer belt; and a detector corresponding to each image bearing member, wherein the detector optically detects a density of a toner image present on a corresponding one of the image bearing members, wherein at least two of the detectors are shifted in the direction of the axis of rotation of the corresponding image bearing member as compared to other detectors.

2. The image forming apparatus according to claim 1, wherein each of the detector is shifted in the direction of the axis of rotation of the corresponding image bearing member as compared to other detectors.

3. The image forming apparatus according to claim 1, further comprising:

a forming unit corresponding to each image bearing member, wherein the forming unit forms a reference patch with a toner on the corresponding image bearing member in a position where the corresponding detector can detect the density; and an image density controlling unit corresponding to each image bearing member, wherein the image density controlling unit controls supply of toner to the corresponding developing unit so as to control density of the image to be formed based on a detection result of the corresponding detector.

4. The image forming apparatus according to claim 2, further comprising:

a forming unit corresponding to each image bearing member, wherein the forming unit forms a reference patch with a toner on the corresponding image bearing member in a position where the corresponding detector can detect the density; and an image density controlling unit corresponding to each image bearing member, wherein the image density controlling unit controls supply of toner to the corresponding developing unit so as to control density of the image to be formed based on a detection result of the corresponding detector.

5. The image forming apparatus according to claim 1, wherein the detectors are disposed near a center of the corresponding image bearing member along the direction of the axis of rotation of the corresponding image bearing member.

6. The image forming apparatus according to claim 3, wherein the forming unit forms the reference patch between one imaging operation and another imaging operation during continuous imaging operation for transferring and forming an image on the recording medium.

7. The image forming apparatus according to claim 4, wherein the forming unit forms the reference toner between one imaging operation and another imaging operation during continuous imaging operation for transferring and forming an image on the recording medium.

8. The image forming apparatus according to claim 1, wherein degree of brilliancy of the surface of the image bearing member is higher than degree of brilliancy of the surface of the intermediate transfer belt.

9. The image forming apparatus according to claim 1, wherein degree of brilliancy of the surface of the intermediate transfer belt is less than or equal to 80.

10. The image forming apparatus according to claim 1, wherein degree of brilliancy of the surface of the image bearing member is more than or equal to 90.

11. The image forming apparatus according to claim 1, wherein a ratio of linear velocity between the surface of the image bearing member and the surface of the intermediate transfer belt is approximately 1.

12. An image forming apparatus comprising:

a plurality of image bearing members, wherein each image bearing member is rotatable around an axis of rotation and bears a latent image;

a charging unit that electrically charge the image bearing member;

a light illuminating unit corresponding to each image bearing member, wherein the light illuminating unit illuminates light on a corresponding one of the image bearing members so as to form a latent image on the image bearing member;

a developing unit corresponding to each image bearing member, wherein the developing unit develops the latent image on a corresponding one of the image bearing members to form a toner image;

an intermediate transfer belt onto which the toner images on the image bearing members are transferred and from where the toner images are transferred onto a recording medium;

a driving unit that drives and rotates the intermediate transfer belt;

a supplying unit that supplies the recording medium to the intermediate transfer belt;

a first detector corresponding to each image bearing member, wherein the first detector optically detects a density of a toner image present on a corresponding one of the image bearing members;

a second detector that opposes to the intermediate transfer belt, wherein the second detector optically detects a density of a toner image present on the intermediate transfer belt;

a forming unit corresponding to each image bearing member, wherein the forming unit forms a reference patch with a toner on the corresponding image bearing member and from where the reference patches are transferred onto the intermediate transfer belt;

a correcting unit that corrects the density detected by the first detectors based on the density detected by the second detector to obtain a corrected density; and an image density controlling unit corresponding to each image bearing member, wherein the image density controlling unit controls supply of toner to the corresponding developing unit so as to control density of the image to be formed based on the corrected density.

13. The image forming apparatus according to claim 12, wherein at least two of the first detectors are shifted in the direction of the axis of rotation of the corresponding image bearing member as compared to other detectors, and the forming unit forms the reference patch on the corresponding image bearing member in a position where the corresponding first detector can detect the density.

14. The image forming apparatus according to claim 12, wherein the second detector is shifted from each of the first detectors in the direction of axial centers of the image bearing members, and the forming unit forms the reference patch at positions where they can be detected by the first detectors and the second detector.

15. The image forming apparatus according to claim 12, wherein the forming unit forms the reference patch to be detected by the second detector in the same imaging condition in which at least one of the reference toner patches to be detected by the first detectors.

16. The image forming apparatus according to claim 12, wherein the image bearing member is provided so as to correspond to each of a plurality of toner colors including black, and the first detector that corresponds to the image bearing member on which the black toner image is formed, and the second detector are located at farthest positions in the direction of axial centers of the image bearing members among all of the first detectors and the second detector.

* * * * *